US011851913B2

(12) United States Patent
Palmieri et al.

(10) Patent No.: US 11,851,913 B2
(45) Date of Patent: Dec. 26, 2023

(54) HOOK BOLT FOR DOOR LOCK

(71) Applicant: Sargent Manufacturing Company, New Haven, CT (US)

(72) Inventors: Eric Palmieri, Rocky Hill, CT (US); Andrew S. Geraci, Durham, CT (US); Richard D. Sangster, Jr., Madison, CT (US); Victor Bogdanov, Manchester, CT (US); Daniel W. Riley, Meriden, CT (US); Ryan Piantek, Middletown, CT (US)

(73) Assignee: Sargent Manufacturing Company, New Haven, CT (US)

( * ) Notice: Subject to any disclaimer, the term of this patent is extended or adjusted under 35 U.S.C. 154(b) by 925 days.

(21) Appl. No.: 16/185,386

(22) Filed: Nov. 9, 2018

(65) Prior Publication Data

US 2019/0178007 A1 Jun. 13, 2019

Related U.S. Application Data

(60) Provisional application No. 62/597,088, filed on Dec. 11, 2017.

(51) Int. Cl.
*E05B 63/14* (2006.01)
*E05B 63/08* (2006.01)
(Continued)

(52) U.S. Cl.
CPC ..... *E05B 63/14* (2013.01); *E05B 59/00* (2013.01); *E05B 63/0004* (2013.01);
(Continued)

(58) Field of Classification Search
CPC ..... E05B 63/0004; E05B 63/08; E05B 63/10; E05B 63/12; E05B 63/127; E05B 63/14; E05B 63/20; E05B 63/0065; E05B 59/00; E05B 65/1086; E05B 13/002; E05B 13/004; E05B 2063/207; Y10T 292/08;
(Continued)

(56) References Cited

U.S. PATENT DOCUMENTS 1,168,525 A * 1/1916 Lurie ..... E05B 85/22 292/150
1,377,658 A * 5/1921 Bock ..... E05B 63/127 70/157

(Continued)

FOREIGN PATENT DOCUMENTS

CA 2487694 A1 5/2005
CH 408693 A 2/1966

(Continued)

OTHER PUBLICATIONS

Machine translation for KR100404749B1 (Year: 2003).*

*Primary Examiner* — Christine M Mills
*Assistant Examiner* — Christopher F Callahan
(74) *Attorney, Agent, or Firm* — Wolf, Greenfield & Sacks, P.C.

(57) ABSTRACT

A hook bolt for a latch assembly includes a hook that deploys laterally from a deadbolt when the deadbolt is moved to an extended position. When the deadbolt is actuated, the hook automatically deploys perpendicular to the deadbolt movement to an engaged position within a corresponding opening in a door jamb to secure the door.

21 Claims, 19 Drawing Sheets

(51) Int. Cl.

| | |
|---|---|
| ***E05B 63/12*** | (2006.01) |
| ***E05B 63/00*** | (2006.01) |
| ***E05B 65/10*** | (2006.01) |
| ***E05B 63/20*** | (2006.01) |
| ***E05B 59/00*** | (2006.01) |
| *E05B 13/00* | (2006.01) |

(52) U.S. Cl.
CPC ..... *E05B 63/08* (2013.01); *E05B 63/12* (2013.01); *E05B 63/127* (2013.01); *E05B 63/20* (2013.01); *E05B 65/1086* (2013.01); *E05B 13/004* (2013.01); *E05B 63/0065* (2013.01); *E05Y 2900/132* (2013.01)

(58) Field of Classification Search
CPC ..... Y10T 292/0801; Y10T 292/0803; Y10T 292/0805; Y10T 292/0806; Y10T 292/0807; Y10T 292/081; Y10T 292/0886; Y10T 292/0887; Y10T 292/0889; Y10T 292/089; Y10T 292/0892; Y10T 292/096; Y10T 292/0961; Y10T 292/0963; Y10T 292/0964; Y10T 292/0967; Y10T 292/0971; Y10T 292/0977; Y10T 292/0989; Y10T 292/0994; Y10T 292/1015; Y10T 292/1016; Y10T 292/102; Y10T 292/1036; Y10T 292/1037; E05C 1/08; E05C 1/12; E05C 1/16; E05C 5/00
See application file for complete search history.

(56) References Cited

U.S. PATENT DOCUMENTS

| | | | | |
|---|---|---|---|---|
| 1,504,176 | A | 8/1924 | Wright | |
| 1,961,483 | A * | 6/1934 | Goldberg | E05B 63/126 70/110 |
| 3,123,387 | A | 3/1964 | Jackson et al. | |
| 3,175,376 | A * | 3/1965 | Cantwell | E05B 17/042 70/145 |
| 3,398,484 | A | 8/1968 | Katsumura et al. | |
| 3,563,585 | A | 2/1971 | Welch | |
| 3,788,687 | A | 1/1974 | Zawadzki | |
| 4,566,725 | A * | 1/1986 | Klein | E05B 63/127 292/191 |
| 4,615,550 | A * | 10/1986 | Abate | E05B 63/127 292/192 |
| 4,643,005 | A | 2/1987 | Logas | |
| 4,708,378 | A | 11/1987 | Ingenhoven | |
| 4,799,718 | A * | 1/1989 | Ing | E05B 63/127 292/36 |
| 4,978,155 | A | 12/1990 | Kobayashi | |
| 5,079,964 | A | 1/1992 | Hamada et al. | |
| 5,149,156 | A | 9/1992 | Kleefeldt | |
| 5,358,274 | A | 10/1994 | Watanabe | |
| 5,373,752 | A | 12/1994 | Schlagwein | |
| 5,531,492 | A | 7/1996 | Raskevicius | |
| 5,746,459 | A | 5/1998 | Giroux, Jr. et al. | |
| 6,119,538 | A | 9/2000 | Chang | |
| 6,152,498 | A | 11/2000 | Lindqvist | |
| 6,282,929 | B1 | 9/2001 | Eller et al. | |
| 6,641,183 | B2 | 11/2003 | Brown | |
| 7,770,944 | B2 | 8/2010 | Yuan | |
| 8,752,871 | B2 | 6/2014 | Rechberg et al. | |
| 9,822,552 | B2 | 11/2017 | Eller et al. | |
| 9,915,084 | B1 * | 3/2018 | Smith | E05C 19/12 |
| 10,094,142 | B2 | 10/2018 | Kondi et al. | |
| 10,465,425 | B2 | 11/2019 | Clark et al. | |
| 11,377,887 | B2 | 7/2022 | Cote et al. | |
| 2004/0195841 | A1 * | 10/2004 | Liu | E05B 63/0013 292/24 |
| 2009/0139283 | A1 | 6/2009 | Peng | |
| 2009/0243306 | A1 * | 10/2009 | Lin | E05B 63/127 70/91 |
| 2010/0263416 | A1 | 10/2010 | Tsai | |
| 2011/0047874 | A1 | 3/2011 | Lowder et al. | |
| 2012/0000257 | A1 | 1/2012 | Wheeler et al. | |
| 2012/0023824 | A1 | 2/2012 | Mason | |
| 2014/0132009 | A1 | 5/2014 | Chiang et al. | |
| 2017/0191288 | A1 | 7/2017 | Lin | |
| 2017/0275922 | A1 | 9/2017 | Zeus et al. | |
| 2017/0292293 | A1 | 10/2017 | Lin | |
| 2019/0178006 | A1 | 6/2019 | Capozziello et al. | |

FOREIGN PATENT DOCUMENTS

| | | | | |
|---|---|---|---|---|
| DE | 36 42 783 | A1 | 6/1987 | |
| DE | 33 18 472 | C2 | 9/1992 | |
| DE | 100 16 609 | A1 | 10/2001 | |
| EP | 0 229 582 | A1 | 7/1987 | |
| EP | 1 520 949 | A2 | 4/2005 | |
| EP | 1 321 613 | B1 | 7/2009 | |
| EP | 3 822 438 | A1 | 5/2021 | |
| FR | 2 733 012 | A1 | 10/1996 | |
| GB | 997748 | A * | 7/1965 | |
| GB | 2 101 667 | A | 1/1983 | |
| GB | 2 275 500 | A | 8/1994 | |
| GB | 2 554 725 | A | 4/2018 | |
| KR | 100404749 | B1 * | 11/2003 | |
| KR | 200456002 | Y1 * | 10/2011 | |
| KR | 10-2011-0135078 | A | 12/2011 | |
| KR | M524384 | U | 6/2016 | |
| WO | WO-2007000476 | A2 * | 1/2007 | E05B 63/127 |
| WO | WO-2010051592 | A1 * | 5/2010 | E05B 63/127 |
| WO | WO-2011083430 | A1 * | 7/2011 | E05B 63/0017 |
| WO | WO-2013160918 | A1 * | 10/2013 | E05B 63/127 |
| WO | WO-2016024274 | A2 * | 2/2016 | E05B 63/126 |

* cited by examiner

HOOK BOLT FOR DOOR LOCK

RELATED APPLICATIONS

This Application claims the benefit of U.S. Provisional Application No. 62/597,088, filed Dec. 11, 2017, entitled "HOOK BOLT FOR DOOR LOCK". The entire contents of this application are incorporated herein by reference in their entirety.

FIELD

Disclosed embodiments are related to an automatic hook engagement feature for a door lock.

BACKGROUND

Traditional locking hardware for swinging doors like a deadbolt are incompatible with sliding doors. Conventionally, a lock for a door is engaged or disengaged by a user or operator turning a knob (when operating the door from the "inside") or using a key or other credential (when operating the door from the "outside"). A conventional deadbolt only lock prevents lateral movement of a swinging door (i.e., in the swinging direction) when the lock is engaged. Conventional deadbolt locks are incompatible with and thus fail to provide security in applications for use with sliding doors that move in a longitudinal (i.e., sliding) direction.

SUMMARY

A hook bolt for a latch assembly includes a deadbolt and at least one hook located at least partially within the deadbolt. The deadbolt is constructed and arranged to move between a retracted deadbolt position and an extended deadbolt position. The at least one hook is constructed and arranged to move between a disengaged position and an engaged position. The at least one hook is constructed and arranged to move from the disengaged position to the engaged position as the deadbolt moves from the retracted deadbolt position to the extended deadbolt position.

A latch assembly for a door includes a chassis, a deadbolt supported by the chassis, and at least one hook located at least partially within the deadbolt. The deadbolt automatically moves relative to the chassis between a retracted deadbolt position and an extended deadbolt position. The deadbolt is held in the retracted deadbolt position. The at least one hook is constructed and arranged to automatically move between a disengaged position and an engaged position. The deadbolt is held in the retracted hook position. A trigger cooperates with the deadbolt and is constructed and arranged to permit the deadbolt to move to the extended deadbolt position. The at least one hook is automatically moved from the disengaged position to the engaged position when the deadbolt is automatically moved from the retracted deadbolt position to the extended deadbolt position.

A door system in combination with a latch assembly of exemplary embodiments includes a door, the latch assembly coupled to said door, and a first handle coupled to said latch assembly and operable to open said door.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Figure 1:
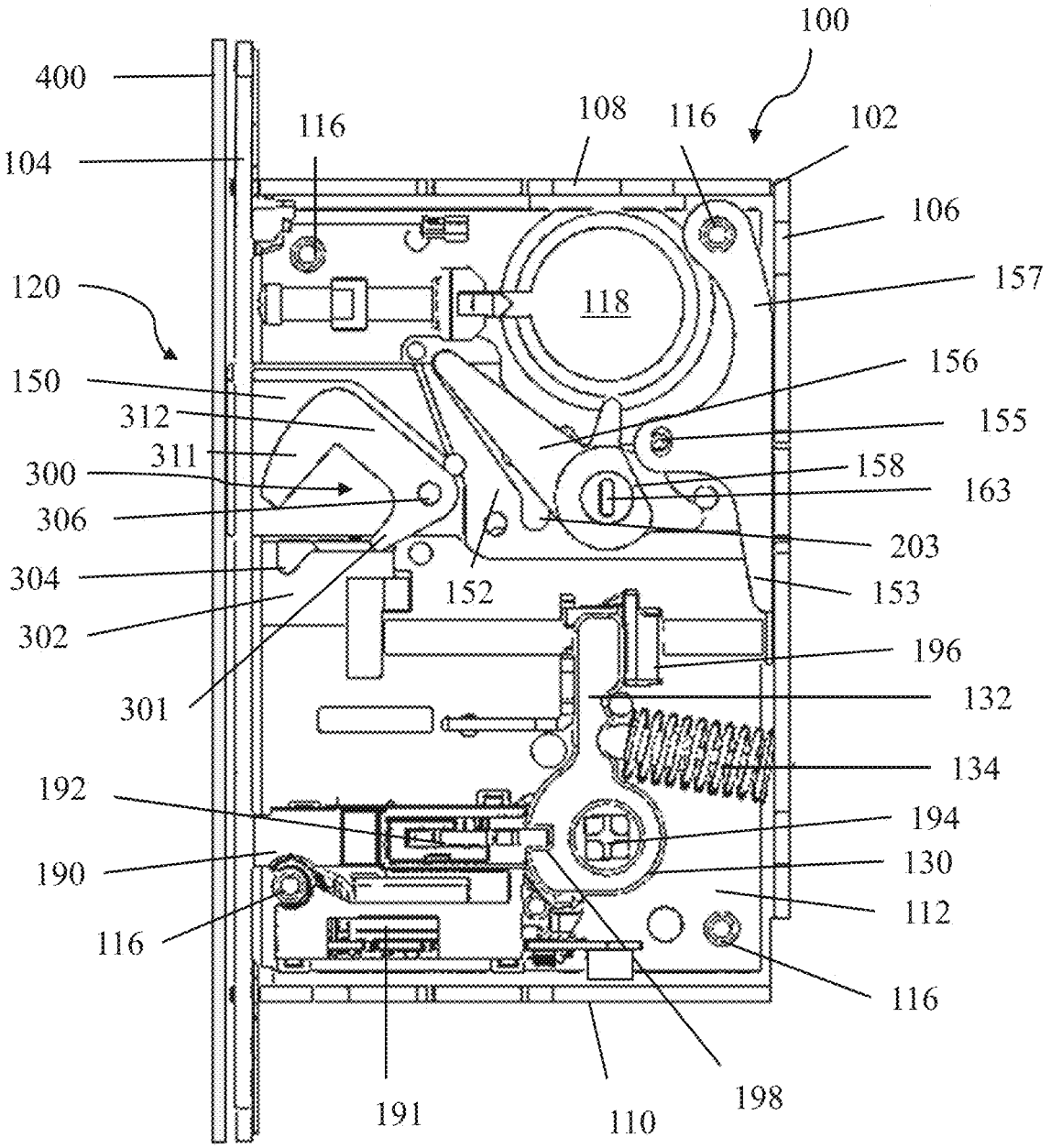
FIG. 1 illustrates a side view of a hook bolt disposed in a latch assembly according to one embodiment with the hook bolt in a retracted hook bolt position.

The present disclosure relates to a hook bolt that includes one or more hooks for engaging a door jamb strike plate. The hook bolt may be used to secure either a sliding door or a swinging door. Accordingly the embodiments herein may be specifically described either with respect to a sliding door or a swinging door or both; however, it should be appreciated that the described embodiment may be utilized in any door style, as the disclosure is not limited in this respect. In one embodiment, the one or more hooks secures a sliding door by contacting an interior side of an associated door jamb strike plate, thereby preventing the sliding door from being retracted (i.e., slid open). Additionally, the hook bolt may afford increased security of a traditional swinging door by increasing the size of one or more lateral contact surface regions in the door jamb. The hook bolt may be employed in any conventional latch assemblies that include a deadbolt, which may provide an added benefit of reducing the cost and expense of developing various locking systems to fit different types of doors. Accordingly, a conventional deadbolt latch assembly including a hook bolt may be employed on a sliding door such that a sliding door can be locked using a latch assembly in a traditional form factor. Additionally, the hook bolt may cooperate with or otherwise include a deadbolt from which the one or more hooks automatically deploy when the deadbolt is extended.

The present disclosure also relates to an automatic latch assembly that deploys the hook bolt upon closing a door. The automatic latch assembly may be used to increase the security of a door by automatically releasing a biased hook bolt to secure the door. In this way, a door may be more consistently secured from unauthorized persons or inclement weather.

In one embodiment, the hook bolt includes a deadbolt and one or more hooks (also referenced to more generally herein as engagement members) positioned at least partially inside of the deadbolt. The hook bolt may be installed in a latch assembly, mortise lock, lock cylinder, or other locking system suitable for use with a swinging or a sliding door. The one or more hooks may be constructed and arranged to move from an disengaged position when the deadbolt is in a retracted deadbolt position to an engaged position when the deadbolt is moved toward the extended deadbolt position. Accordingly, the hook bolt may also include a hook actuator configured to move the one or more hooks as the deadbolt is moved from the retracted to the extended position, thereby causing the one or more hooks to engage an associated door jamb strike plate by projecting out of one or more sides of the deadbolt. That is, the one or more engagement members of the hook bolt extend out of the deadbolt perpendicular (i.e., laterally) to the longitudinal movement direction of the deadbolt. The hook actuator may also contact the one or more hooks as the deadbolt is retracted, thereby causing the hooks to move to a disengaged position substantially inside of the deadbolt (i.e., inside of the perimeter of the deadbolt). Thus, the hooks may be substantially contained within the deadbolt when the deadbolt is retracted, and may be moved to an engaged position as the deadbolt is extended. Such an arrangement may allow a hook bolt to be used on either a sliding door or a swinging door without a significant change in locking hardware, thereby reducing cost and improving simplicity of installation.

In some embodiments, the one or more hooks of the hook bolt may include one or more pivots by which the hooks rotate between the engaged and disengaged positions. According to this embodiment, the hook actuator may contact the one or more hooks to cause the one or more hooks to rotate about the pivot between the disengaged and engaged positions. Additionally, the hook actuator may be passive, such that the contact with the one or more hooks occurs automatically as the deadbolt is extended or retracted to move the one or more hooks between the disengaged and engaged positions. Thus, in the disengaged position the one or more hooks may be rotated by the hook actuator such that the hooks are substantially within the deadbolt and in an engaged position the one or more hooks may be rotated by the hook actuator such that the hooks deploy laterally outside of the deadbolt. In some embodiments, the hook may include a hook bend, a hook shank, and a lower hook leg. In such an arrangement, the hook bend may rotate through an opening in an associated door in a direction perpendicular to a longitudinal movement direction of the deadbolt. That is, the hook may rotate through the opening such that the hook shank is substantially parallel with the longitudinal movement direction of the deadbolt. In this position, the hook bend may be positioned outside of the opening, and the lower hook leg may be positioned inside of the opening. Thus, the hook may span the opening, such that the door can be secured to an associated door jamb strike plate located between the hook bend and the lower hook leg.

According to yet another embodiment, a linkage constructed and arranged to link together the motion of two or more hooks may be employed, such that one hook actuator may cause the two or more hooks to move to the disengaged or engaged positions concurrently. Such a linkage may be a link, a gear, or any other suitable structure for linking the two or more hooks and causing them to move together toward the disengaged or engaged position. According to this embodiment, two or more hooks may be deployed to the engaged position by a single hook actuator, such that number of actuators in the hook bolt is reduced. Additionally, such an arrangement may allow the two or more hooks to engage an associated door jamb at multiple locations, such that the failure of any one hook may not compromise the security of a locked door. Accordingly, such an arrangement may provide additional security than a lock employing a single hook.

In yet another embodiment, a latch assembly including a hook bolt may be installed on a door to automatically engage the hook bolt with a door jamb strike plate when the door is closed. The hook bolt may automatically move to an extended position when a door is closed, thereby causing one or more hooks to deploy. The hook bolt may include a deadbolt biasing member (e.g., a spring) that urges the hook bolt to the extended (i.e., locked) position. The hook bolt may further include a catch configured to hold the hook bolt in place when the door is not closed by resisting force from the deadbolt biasing member. The hook bolt may also include a slide mechanism arranged to allow a turning motion of a deadbolt handle to extend or retract the hook bolt. The slide mechanism may also be configured to prevent the retraction of the hook bolt without a corresponding turn of the deadbolt handle, thereby increasing the security of the door.

In yet another embodiment, the latch assembly may include an auxiliary bolt that cooperates with the hook bolt to automatically trigger the hook bolt to move into the extended position. The auxiliary bolt may be connected to an auxiliary biasing member that urges the auxiliary bolt to an extended auxiliary position. The auxiliary bolt may further include an auxiliary bolt head with an inclined face configured to retract the auxiliary bolt when the auxiliary bolt head strikes a door frame. The auxiliary bolt may include one or more tabs located on an auxiliary arm arranged to contact a guard lever. In some embodiments, the guard lever is moveable by the auxiliary bolt and includes a sear constructed and arranged to contact a catch on the hook bolt. The guard lever may be moved between a secure position and a free position by the one or more tabs or auxiliary arm on the auxiliary bolt as the auxiliary bolt is correspondingly retracted or extended. In the free position, the sear may contact and engage the catch on the hook bolt to resist urging force from the deadbolt biasing member and thereby prevent the hook bolt from being extended. In the secure position, the guard lever may be moved to a position where the sear is released from the catch, thereby releasing the hook bolt and allowing the hook bolt to automatically extend from the urging force received from the deadbolt biasing member. According to the present embodiment, the auxiliary bolt may prevent the hook bolt from moving to the extended position when the auxiliary bolt is in an extended position. When the auxiliary bolt is retracted the one or more tabs may force the guard lever to the secure position to release the sear from the catch which allows the hook bolt to extend. Such an arrangement may prevent an extension of the hook bolt that may otherwise cause jams or prevent damage to a door frame by releasing the hook bolt only when auxiliary bolt strikes a door frame and is sufficiently retracted.

In yet another embodiment, the latch assembly may include a lock switch configured to lock the operation of an attached door handle. For example, the latch assembly may include a lock switch constructed and arranged to selectively move a lock switch arm into a locked switch position or an unlocked switch position. In the locked switch position, the lock switch arm may engage a notch or other suitable structure on a door lever hub arranged to receive and mount a door handle, thereby preventing the rotation of the door handle and lever hub. In the unlocked switch position, the lock switch arm may move away from the notch or other suitable structure to allow free rotation of the door handle and lever hub. In some embodiments, the lock switch may prevent rotation of the lever hub and door handle only from one side (e.g., exterior side of the door). Such an arrangement may be beneficial to increase the security of the door by preventing manipulation of the door handle from outside of the secured space. In some cases, it may be beneficial to bypass the lock switch if a user has the appropriate credentials (e.g., a key). Accordingly, the lock switch may be moved to the unlocked switch position or otherwise move from engaging the lever hub to permit the rotation thereof by the hook bolt. Such an arrangement may allow a user with appropriate credentials (e.g., a key) to move the lock switch to the unlocked switch position from the exterior side of the door, thereby allowing the user to turn the door handle from said exterior side to open the door.

Now turning to the figures, FIG. 1 depicts a hook bolt 120 which in this example is installed in a latch assembly 100 embodied here as a mortise lock for a door. The latch assembly 100 includes a chassis or housing 102 having front plate 104, rear plate 106, top plate 108, bottom plate 110, and side plates 112 (one side plate is omitted from FIG. 1 to expose internal components of the latch assembly 100). The hook bolt 120 includes a deadbolt 150 and a hook 300. The hook 300 includes a lower hook leg 301, a hook bend 311, and a hook shank 312. As shown in FIG. 1, the deadbolt 150 is in a retracted deadbolt position and the hook 300 is in a disengaged position. In this position, the hook is located partially within the deadbolt. That is, the hook bend 311 and hook shank 312 are positioned within the deadbolt 150, while lower hook leg 301 is located partially within the deadbolt, projecting out of the bottom of the deadbolt. As would be appreciated by one of skill in the art, the phrase "within the deadbolt" means within the external projected perimeter of the deadbolt. In this position, the hook is substantially contained within the deadbolt, such that the hook takes up little additional space inside the latch assembly not already occupied by the deadbolt. Thus, the hook bolt may be employed in a wide variety of doors and latch assemblies with deadbolt of a standard size, without requiring significant redesign or reconstruction. Of course, any suitable arrangement of the hook may be employed such that the hook is positioned at least partially within the deadbolt.

In the embodiment shown in FIG. 1, the hook 300 includes a pivot 306, a lower hook leg 301 and a hook bend 311. The pivot 306 is constructed and arranged to allow the hook to rotate (i.e., pivot) about the axis of the pivot. In some embodiments, the pivot may be a pin attached to the deadbolt 150 through a hole in the hook. However, any suitable structure may be employed, such that the pivot 306 allows the hook 300 to rotate about the axis of the pivot 306. The hook bolt 120 also includes a hook actuator 302, constructed and arranged as a passive hook actuator block with a contact area 304 constructed and arranged as a recess. Of course, the hook bolt actuator may be any suitable actuator that moves the hook between an engaged and disengaged position, including but not limited to an active actuator like a servo, motor, magnet, hydraulic actuator, or any other suitable actuator. In the depicted embodiment, contact area 304 contacts the lower hook leg 301 as it falls into the contact area when the deadbolt is moved between a retracted and extended deadbolt position. Of course, any suitable contact area may be employed such that the contact area contacts the hook as the hook bolt is moved from a retracted position to an extended position as the present disclosure is not so limited. When deadbolt 150 is moved to an extended position, the lower hook leg 301 moves into the contact area 304, which provides a reaction force against the lower hook leg such that a torque is generated to rotate the hook 300 around pivot 306. In the present embodiment, the lower hook leg 301 also falls into the contact area 304, such that gravity provides a rotational force to pivot the hook 300 about pivot 306 to the engaged position. Of course, any suitable arrangement may be employed to rotate the hook toward the engaged position as the present disclosure is not so limited. As the hook is rotated around pivot 306, hook bend 311 is lowered out of the bottom of the deadbolt to the engaged position (for example, see FIG. 2).

According to the present embodiment, a door jamb strike 400 of an associated door includes an opening sized to receive the deadbolt 150 and the hook 300. As discussed above, the hook 300 includes pivot 306, hook bend 311, hook shank 312, and a lower hook leg 301. In the engaged position, the hook shank 312 spans the opening of the door jamb strike plate, with the hook bend 311 preventing sliding or swinging movement of the door by contacting an interior side of the door jamb strike plate. Thus, the hook will prevent a sliding door from being opened, or afford additional security for a swinging door by increasing the size of one or more contact regions. In some embodiments, when the hook bolt is in the extended hook bolt position, the hook 300 is prevented from rotating about the pivot 306 by lower hook leg 301 and contact area 304 without a corresponding retraction of the deadbolt. In this embodiment, the lower hook leg 301 contacts the contact area 304 which provides a reaction force opposing any externally applied forces that may rotate the hook to a disengaged position, and thus the hook is prevented from rotating toward the disengaged position while the hook bolt is in the extended hook bolt position. When deadbolt 150 is retracted, lower hook leg 301 contacts contact area 304 which provides a reaction force to rotate the hook 300 up about pivot 306 to move the hook to the disengaged position wherein the hook is substantially contained within the deadbolt 150. In certain embodiments, the hook 300 and hook actuator 302 may be arranged near the top of the deadbolt, such that the hook projects substantially outside of a top side of the deadbolt 150, as the present disclosure is not so limited.

AS noted above, the latch assembly 100 depicted in FIG. 1 includes a chassis 102 or housing having a front plate 104, rear plate 106, top plate 108, and side plates 112 (one of which is omitted from FIG. 1 to expose the internals of the latch assembly). Front plate 104 may have holes 114 through which screws or bolts may be used for securing or fastening the latch assembly 100 to a door. For example, there may be two holes, one at a top of front plate 104 and another at a bottom of front plate 104, or there may be more or fewer holes. Other suitable devices for securing or fastening the latch assembly 100 to a door may also be used as the disclosure is not limited in this respect. Front plate 104 further includes openings for one or more of hook bolt 120, latch bolt 122, auxiliary bolt 124, and lock switch 126. Chassis 102 may be secured together by screws 116 passing through side plates 112. For example, four screws, one at each corner of side plates 112, may be used, or more or fewer screws or other fastening devices or methods in other suitable arrangements. Chassis 102 may be formed out of one or more pieces. For example, in some embodiments, rear plate 106, top plate 108, bottom plate 110, and one of side plates 112 may be formed as a single integral piece of material (e.g., metal, plastic, or some other material or combination of materials) that is secured or fastened to front plate 104 or the opposing one of side plates 112 or both by, e.g., screws, bolts, rivets, snap or press fit, welding, or some other fastening device or method or combination of fastening devices or methods. In some embodiments, chassis 102 may include one or more slots in either or both of side plates 112 to facilitate moving or sliding pieces inside of the latch assembly. Chassis 102 may also include a hole or space 118 to receive a lock mechanism, such as a key-operated cylinder lock, an electromechanical lock, etc.

Figure 2:
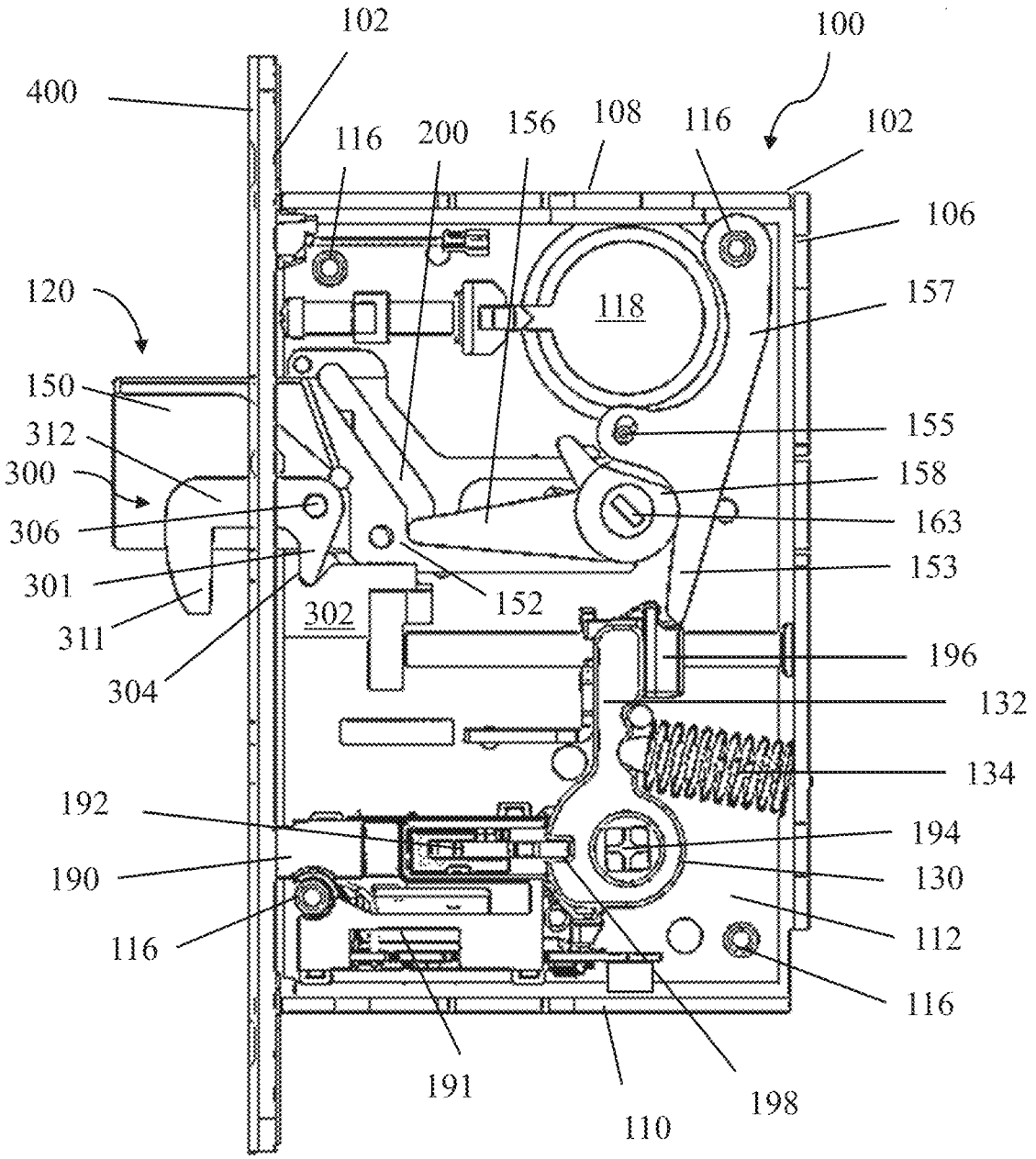
FIG. 2 illustrates a side view of the hook bolt of FIG. 1 with the hook bolt in an extended hook bolt position.

As shown in FIG. 1, hook bolt 120 also includes a deadbolt arm 156 and a deadbolt backstop 157. Deadbolt 150 protrudes from chassis 102 and front plate 104 when the deadbolt is in an extended position and is within or substantially within a profile of the chassis 102 when the deadbolt is in a retracted position. In the depicted embodiment, deadbolt 150 is hollow, although the deadbolt may be solid with a recess formed therein to accommodate the hook. Of course, any other suitable arrangement for the deadbolt may be employed such that one or more hooks are accommodated by the deadbolt as the present disclosure is not so limited. Hook bolt 120 also includes a slide mechanism 152 extending from the deadbolt 150 and including one or more slots. Slide mechanism 152 includes one or more slots and lower deadbolt leg 154. Deadbolt arm 156 is rotatably mounted in the chassis and has a protrusion that extends (into the page) into the cam slot of slide mechanism 152. The deadbolt arm also includes a thumb turn 158 having a slot 163 about which the deadbolt arm 156 rotates. When thumb turn 158 is turned, for example by a user operating a knob or key engaging the thumb turn slot, the protrusion of deadbolt arm 156 contacts an edge cam slot in the slide mechanism 152 in a camming fashion and causes the hook bolt 120 to move relative to the chassis 102 between a retracted position and an extended position (see FIG. 2). In one embodiment, the cam slot in the slide mechanism 152 is angled at a lower slot 203 thereof such that, when the hook bolt 120 is in the extended position (as shown in FIG. 2), the hook bolt 120 is prevented from moving relative to the chassis 102 as the deadbolt arm 156 is aligned with the deadbolt 150 and a retracting force on the deadbolt will simply cause the lower slot 203 of the slot 201 to bear against the protrusion of the deadbolt arm 156 without rotating the deadbolt arm. The deadbolt backstop 157 includes a lower deadbolt lever arm 153 and is rotatably mounted in the chassis and connected to the deadbolt arm by a pin 155, such that rotation of the deadbolt backstop and the deadbolt arm are linked. That is, rotation of the deadbolt backstop will rotate the deadbolt arm, and rotation of the deadbolt arm will rotated the deadbolt backstop.

The latch assembly 100 of FIG. 1 also includes a lever hub 130 arranged to couple to a door handle via hole 194. The lever hub includes a lever hub arm 132 and a lever spring 134 arranged to bias the lever hub to an upright position, as shown in FIG. 1. The lever hub arm 132 contacts an end 196 of an optional latch bolt (not shown in the figure). The end 196 is arranged to contact the lower deadbolt lever arm 153 of deadbolt backstop 157 when the lever hub is actuated by the associated door handle, thereby causing the hook bolt 120 to move toward the retracted position. Accordingly, the associated door handle may be able to actuate the hook bolt 120 and any optional latch bolt (not shown in the figure) to open a door with a single motion, thereby affording additional simplicity to the use of the latch assembly 100. The lever hub 130 may also include a notch 198 arranged to receive a lock switch arm 192 which is connected to a lock switch rocker 190. The lock switch arm 192 may be moved between a locked switch position and an unlocked switch position by the lock switch rocker 190, such that in the locked switch position the lock switch arm 192 contacts notch 198 to prevent rotation or actuation of lever hub 130. Accordingly, the lock switch rocker 190 may be used to prevent an associated door handle from being actuated on at least one side of a door. For example, the lock rocker switch 190 may be used to prevent the door handle from being actuated from an exterior (i.e., unsecured) side of a door, thereby improving security while still allowing a user on the interior (i.e., secured) side of a door to actuate the handle to unlock and open the door. As shown in the depicted embodiment, the lock switch includes an auxiliary actuator 191 arranged here as an electronic motor. The auxiliary actuator may cooperate with an authentication system, door management system, or other access control system to selectively move the lock switch arm 192 between the locked and unlocked positions. While an electronic motor is employed in the depicted embodiment, any suitable actuator may be used, such as a servo, linear actuator, electromagnet, hydraulic piston, etc. as the present disclosure is not so limited.

FIG. 2 depicts the hook bolt in the latch assembly of FIG. 1 with the deadbolt 150 in an extended deadbolt position and the hook 300 in an engaged position. As shown in the figure, the deadbolt 150 is fully extended with deadbolt arm 156 in a lower cam slot of sliding mechanism 152. Lower hook leg 301 is contacting hook actuator 302 at the contact area 304, such that the hook 300 is rotated down about pivot 306 and is projecting substantially outside of the deadbolt 150. As discussed above, door jamb strike 400 of an associated door includes an opening sized to receive the deadbolt 150 and the hook 300 as the hook rotates around and through the opening to the engaged position such that the hook shank 312 spans the opening. Thus, in the engaged position, the hook 300 prevents an associated sliding door from retracting (i.e., sliding open) by contacting an interior side of the door jamb strike plate 400. In the depicted embodiment, the hook 300 is prevented from rotating about the pivot 306 by lower hook leg 301 and contact area 304 without a corresponding retraction of the deadbolt. The lower hook leg 301 contacts contact area 304 which provides a reaction force opposite to any externally applied forces that may rotate the hook to a disengaged position, and thus the hook is prevented from rotating back to the retracted position while the hook bolt is in the extended hook bolt position. Accordingly, the hook bolt can only be retracted by a corresponding rotation of the deadbolt arm 156. Without wishing to be bound by theory, in the engaged position, the hook 300 also may afford additional security to a swinging door by increasing the size of one or more lateral contact regions which prevents the door from opening in a lateral (i.e., swinging) direction.

As shown in the depicted embodiment, when the hook bolt is in the extended position, the deadbolt backstop 157 contacts end 196 of an optional latch bolt. The lever hub 130 contacts end 196 via lever hub arm 132, such that when a door handle attached through hole 194 is actuated the lever hub 130 rotates and causes deadbolt backstop to rotate deadbolt arm 156 through pin 155. Accordingly, the deadbolt arm 156 moves up cam slot 200 to retract the deadbolt 150. As the deadbolt 150 is retracted, lower hook leg 301 contacts contact area 304 which provides a reaction force (i.e. pushing or camming force) to rotate the hook 300 up about pivot 306 into the deadbolt. As shown in the figure, the contact area 304 is constructed and arranged as a recess with a ramp. The ramp allows the lower hook leg 301 to smoothly transition between the engaged and disengaged positions. Thus, the hook bolt 120 moves back to the retracted hook bolt position as shown in FIG. 1. Of course, any suitable contact area may be employed such that a reaction force provided by the contact area may reliably move the hook between the engaged and disengaged positions.

Figure 3:
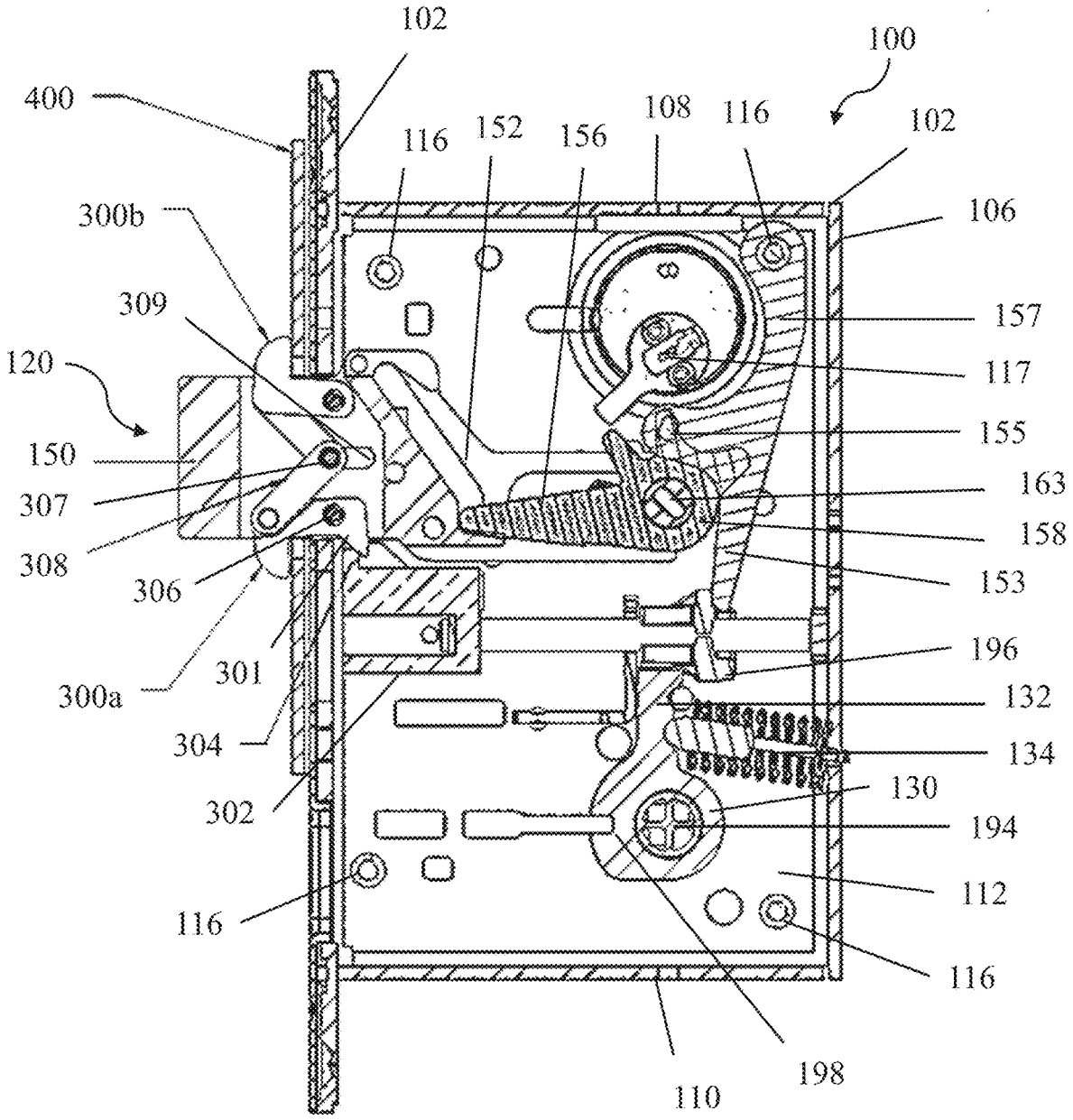
FIG. 3 illustrates a side view of a hook bolt disposed in a latch assembly according to another embodiment with the hook bolt in an extended hook bolt position.

FIG. 3 shows another embodiment of a hook bolt 120 disposed within a latch assembly 100 embodied here as a mortise lock. In this embodiment, the hook bolt includes two hooks 300*a*, 300*b* located at least partially within deadbolt 150, with lowermost hook 300*a* including a lower hook leg 301. The hook bolt 120 includes a linkage 308 joined to a linkage pin 307 located in a linkage slot 309. The linkage 308 may rotate about linkage pin 307. The linkage 308 links the motion of the hooks 300*a*, 300*b*, such that the hooks 300*a*, 300*b* are moved to the disengaged position or engaged position concurrently. Specifically, in the engaged position as shown in the figure, hook actuator 302 contacts lower hook leg 301 at contact area 304. The contact area 304 provides a reaction force that creates a torque on a lowermost hook 300*a* to rotate about pivot 306 toward the engaged position. As lowermost hook 300*a* is rotated about pivot 306, the linkage 308 attached to linkage pin 307 is forced to move in the direction of hook bolt extension along the linkage slot 309, thereby causing uppermost hook 300*b* to rotate up into an engaged position along with lowermost hook 300*a*. Such a hook arrangement provides multiple regions of contact for the hook bolt 120, thereby increasing security of the hook bolt mechanism. For example, if one hook was damaged (e.g., by an attempted break in), the other hook would still be able to secure the door. As shown in the depicted embodiment, the hooks 300*a*, 300*b* engage an interior side of an associated door jamb strike 400, which prevents a corresponding sliding door from retracting (i.e., being slid open), or otherwise increases security of a corresponding swinging door.

Similarly to the embodiment depicted in FIGS. 1-2, the hook bolt 120 depicted in FIG. 3 is moved between an extended and retracted position by the deadbolt arm 156. Deadbolt arm 156 contacts sliding mechanism 152 at a cam slot, which allows the rotation of deadbolt arm 156 to move the hook bolt 120 between an extended and retracted position. When the deadbolt arm 156 is in a lower position as shown in the figure, a lower portion of the cam slot of sliding mechanism 152 prevents the hook bolt from moving toward the retracted position. Thus, the hook bolt may be retracted by thumb turn 158 which is coupled to lock cylinder 117 to allow a user to move the deadbolt arm 156 by using a key or other credential. Such an arrangement may prevent the deadbolt from being retracted from an external force on an end of the deadbolt in an attempt to defeat the hook bolt, thereby increasing security of the hook bolt. While in the depicted embodiment a lock cylinder is used, any suitable structure may be employed, including but not limited to a deadbolt handle, electromechanical lock, etc. as the present disclosure is not so limited.

Figure 4:
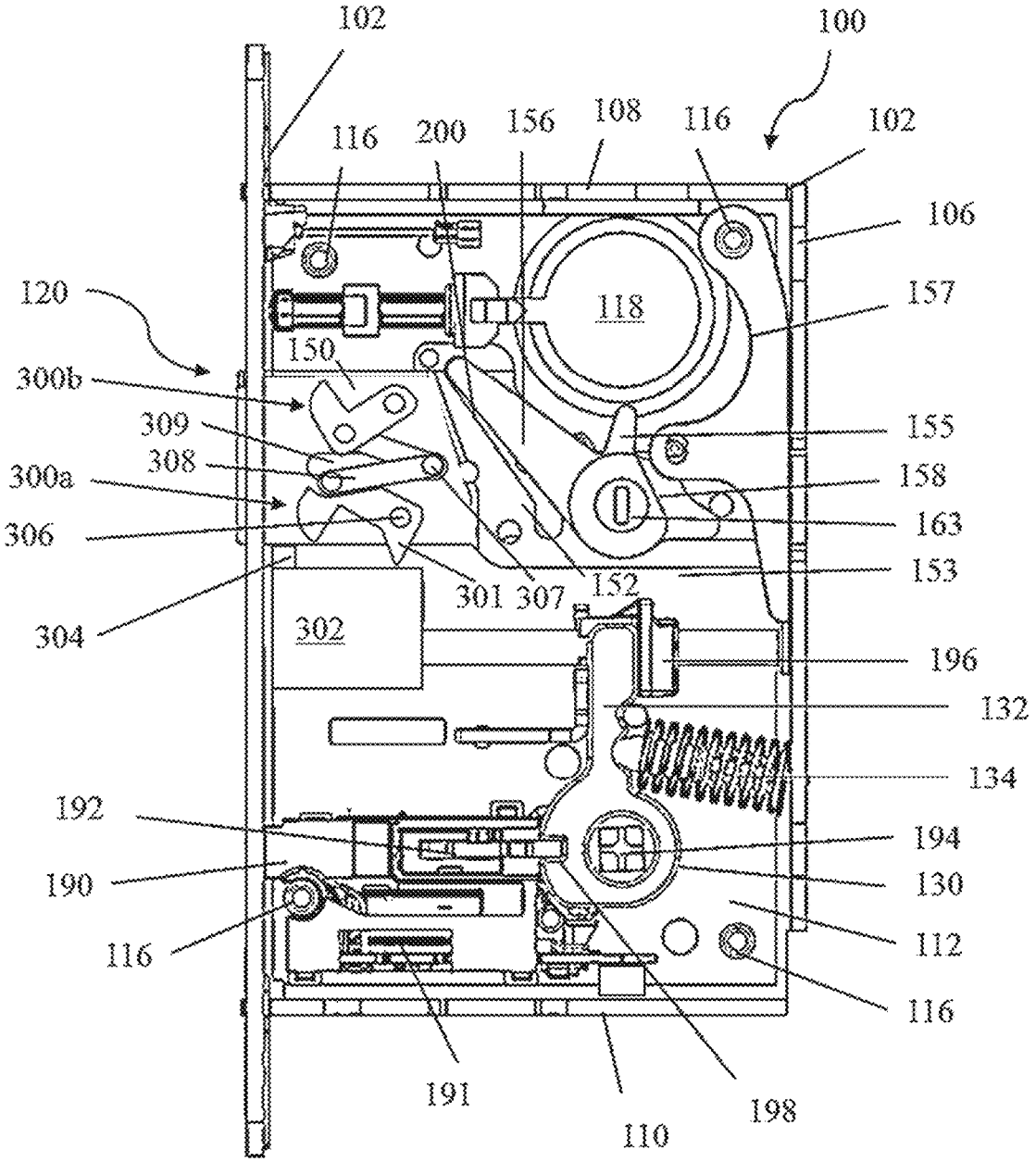
FIG. 4 illustrates a side view of the hook bolt of FIG. 3 with the hook bolt in a retracted hook bolt position.

FIG. 4 shows the hook bolt 120 of FIG. 3 in the retracted hook bolt position. As shown in the figure and explained above, the hooks 300*a*, 300*b* include a lower hook leg 301 and linkage 308 with a pin 307 in a linkage slot 309. The linkage 308 links the motion of the lowermost hook 300*a* and uppermost hook 300*b*. As the hook bolt is retracted the hooks 300*a*, 300*b* contact front plate 104, such that the front plate provides a reaction force that causes the hooks to rotate toward a disengaged position. As the hooks rotate toward the disengaged position, the linkage 308 moves relative to the deadbolt 150 in the direction of retraction, such that the hooks can move (i.e., rotate) to be substantially contained by the deadbolt. As shown in the figure, the hook bolt includes a hook actuator 302 including a contact area 304. In the disengaged position, the lower hook leg 301 protrudes from the deadbolt 150, such that when the hook bolt is moved toward the extended position the lower hook leg contacts the contact area 304 to move the hooks to the engaged position as described above. As the lower hook leg contacts the contact area and rotates lowermost hook 300*a*, the linkage transmits that motion to uppermost hook 300*b* though pin 307 as the linkage is moved along linkage slot 309 relative to the deadbolt in the extending direction. Thus, the contact of lower hook leg 301 is sufficient to deploy both hooks concurrently with an extending motion of the hook bolt.

Figure 5:
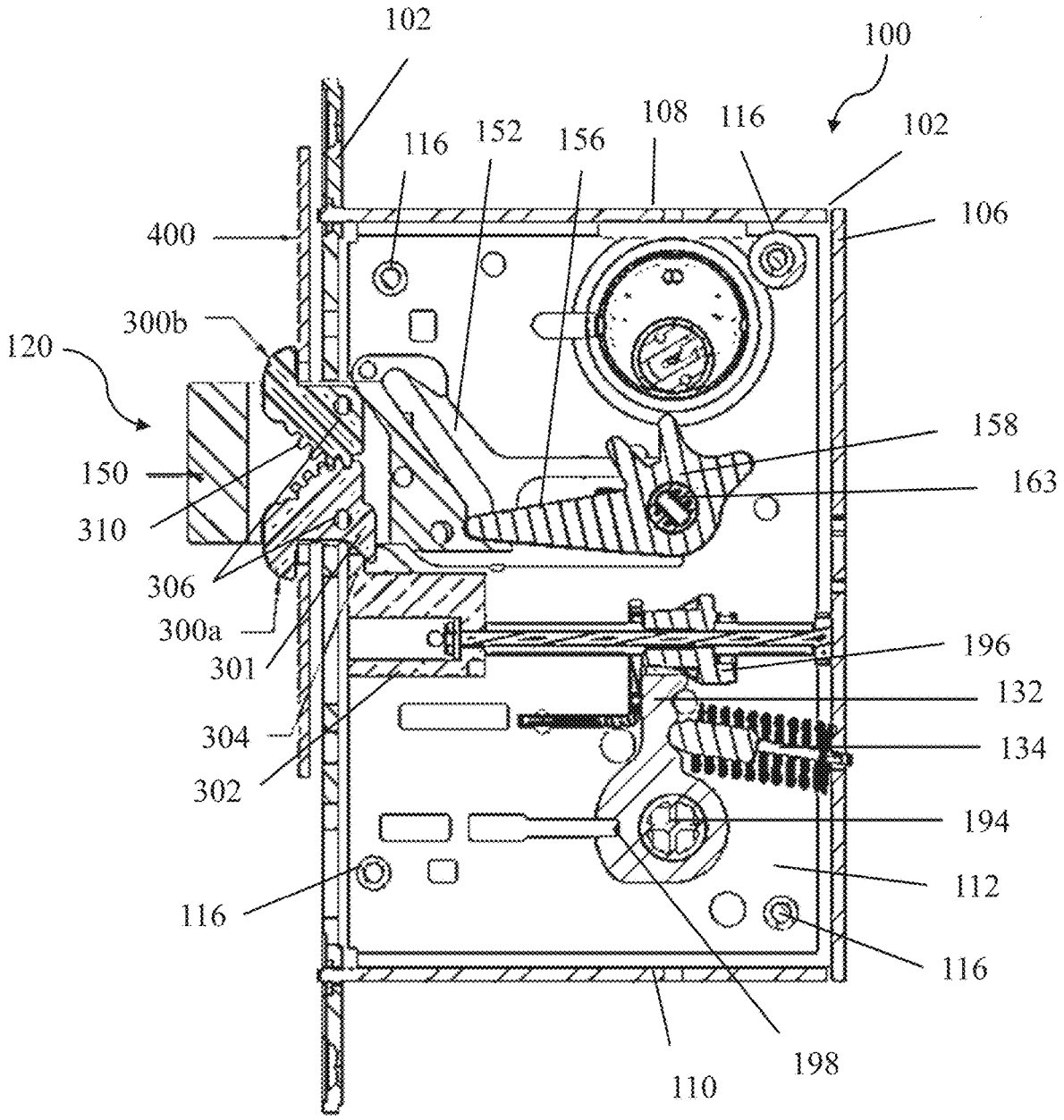
FIG. 5 illustrates a side view of a hook bolt disposed in a latch assembly according to yet another embodiment with the hook bolt in an extended hook bolt position.

FIG. 5 shows yet another embodiment of a hook bolt 120 disposed in a latch assembly 100 embodied as a mortise lock. In this embodiment, the hook bolt includes two hooks in an opposing vertical arrangement similar to that of FIG. 3 as well as a hook actuator 302 with a contact area 304. Lowermost hook 300*a* and uppermost hook 300*b* each have a pivot 306, about which each hook 300*a*, 300*b* pivots between an engaged and disengaged position. Additionally, lowermost hook 300*a* includes a lower hook leg 301. In this embodiment, the lowermost hook 300*a* and uppermost hook 300*b* are formed with gear teeth 310 linking the two hooks together. The gear teeth may be formed into the hook, such that the hooks with gears may be created as a single piece, or the gear teeth may be added to the hook separately. Accordingly, the rotational movement of the hooks 300*a*, 300*b* is linked, such that the lowermost hook 300*a* and uppermost hook 300*b* move concurrently between the engaged and disengaged positions. As shown in the figure, lower hook leg 301 contacts hook actuator 302 at contact area 304, thereby forcing lowermost hook 300*a* to rotate around pivot 306 and down to project substantially outside of a bottom side of the deadbolt 150. The gears 310 transfer the rotation of the lowermost hook 300*a* to rotation of the uppermost hook 300*b*, thereby causing the uppermost hook to rotate around pivot 306 and up to project substantially outside a top side of the deadbolt 150. Thus, the hooks are moved to project laterally from the deadbolt. Such an arrangement may provide more consistent transfer of motion with reduced complexity by reducing the number of separate components in the hook bolt. The gear teeth 310 may be any suitable gear teeth arrangement to transfer the rotational motion of one hook to the other, including but not limited to cycloid or involute gear teeth.

Figure 6:
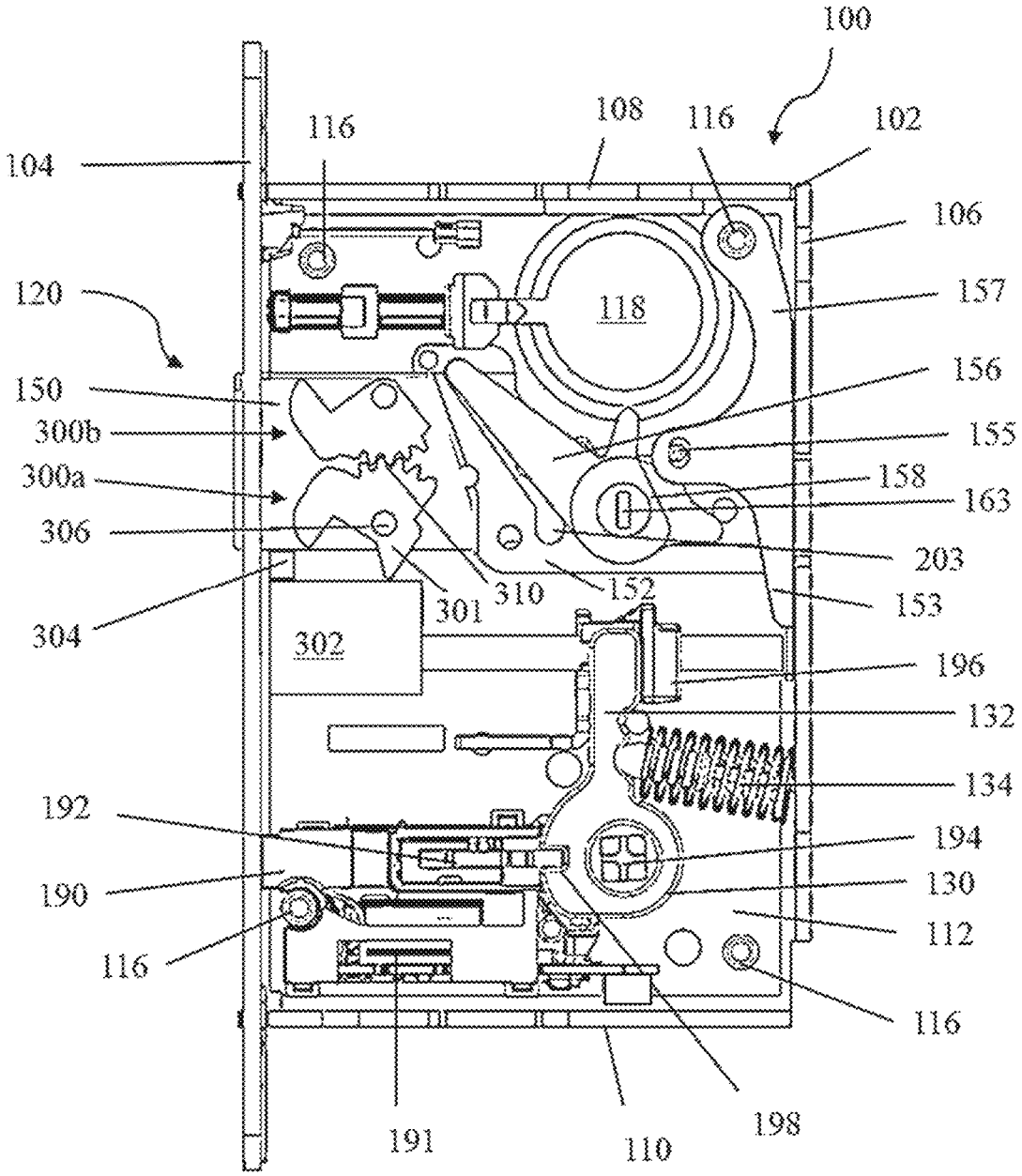
FIG. 6 illustrates a side view of the hook bolt of FIG. 5 with the hook bolt in a retracted hook bolt position.

FIG. 6 shows the hook bolt of FIG. 5 in the retracted hook position. As shown in the figure and explained above, the hooks 300*a*, 300*b* include a lower hook leg 301 and gear teeth 310. The gear teeth 310 link the motion of the lowermost hook 300*a* and uppermost hook 300*b*. As the hook bolt is retracted the hooks 300*a*, 300*b* contact front plate 104, such that the front plate provides a reaction force that causes the hooks to rotate toward a disengaged position. As the hooks rotate toward the disengaged position, the gear teeth 310 mesh to link the motion of the hooks as they rotate to be substantially contained by the deadbolt. As shown in the figure, the hook bolt includes a hook actuator 302 including a contact area 304. In the disengaged position, the lower hook leg 301 protrudes from the deadbolt 150, such that when the hook bolt is moved toward the extended position the lower hook leg contacts the contact area 304 to move the hooks to the engaged position as described above. The gear teeth 310 link the motion of the hooks 300*a*, 300*b*, such that the contact of lower hook leg 301 is sufficient to deploy both hooks simultaneously with an extending motion of the hook bolt.

Figure 7:
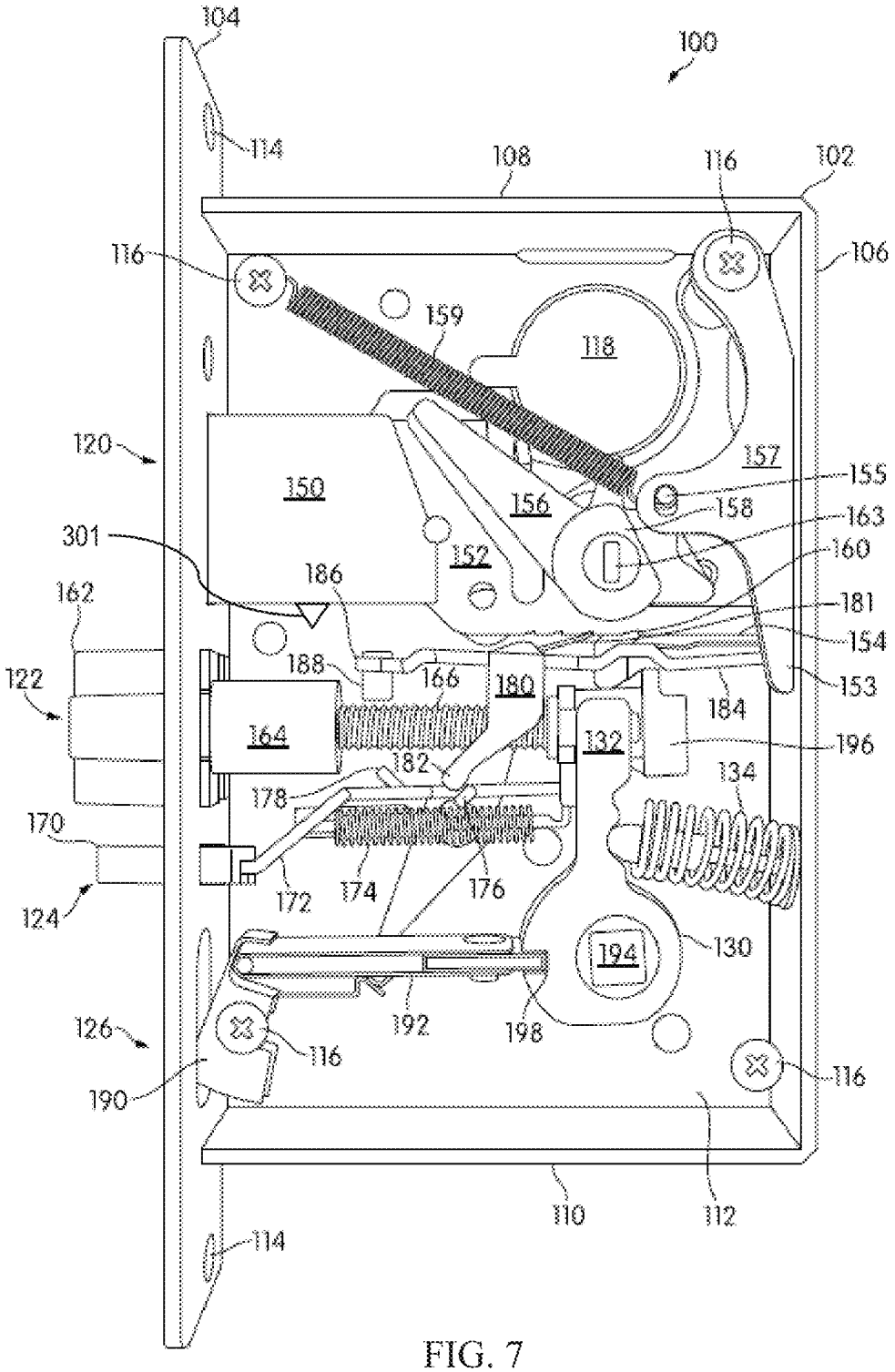
FIG. 7 illustrates a side perspective view of a latch assembly including a hook bolt according to yet another embodiment.
Figure 8A:
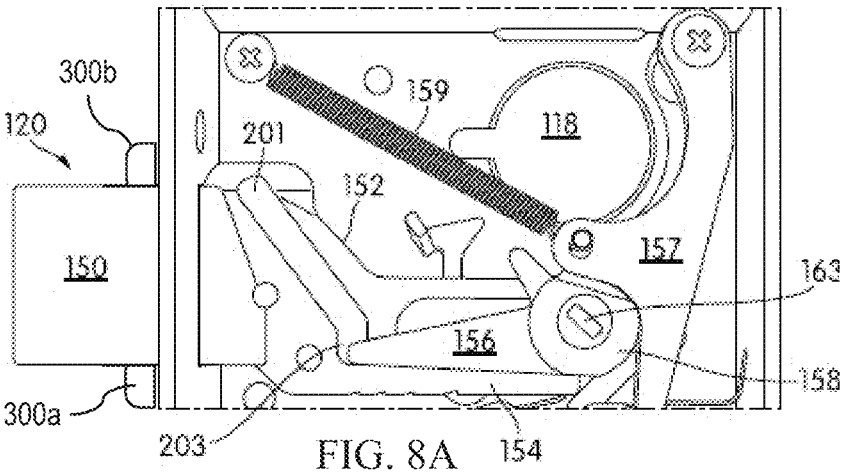
FIGS. 8A-8C illustrate detailed views of the hook bolt within the latch assembly of FIG. 7.

FIG. 7 depicts latch assembly 100 having automatic deployment of the hook bolt. Hook bolt 120 includes hooks 300*a*, 300*b*, deadbolt 150, a deadbolt arm 156, and a deadbolt backstop 157. Hooks 300*a* and 300*b* are not completely shown in FIG. 7 because they are at least partially contained within the deadbolt. Deadbolt 150 protrudes from chassis 102 and front plate 104 when hook bolt 120 is in the extended hook bolt position and is within or substantially within a profile of the chassis 102 when hook bolt 120 is in the retracted hook bolt position. When the hook bolt is in the extended hook bolt position, the hooks 300*a*, 300*b* are in an engaged position, projecting out of the deadbolt. Hook bolt 120 also includes a slide mechanism 152 extending from the deadbolt 150 and including one or more slots. Slide mechanism 152 includes one or more slots (e.g., cam slot 201 shown in FIGS. 8A-8C) and lower deadbolt leg 154. Hook bolt 120 also includes deadbolt arm 156 rotatably mounted within the chassis 102. Deadbolt arm 156 has a protrusion that extends (into the page) into the cam slot 201 of slide mechanism 152 and a thumb turn 158 having a slot 163 about which the deadbolt arm 156 rotates. When thumb turn 158 is turned, for example by a user operating a knob or key engaging the thumb turn slot, the protrusion of deadbolt arm 156 contacts an edge cam slot 201 in the slide mechanism 152 in a camming fashion and causes the hook bolt 120 to move relative to the chassis 102 between a retracted hook bolt position and an extended hook bolt position (see FIGS. 8A-8C). In one embodiment, the cam slot 201 in the slide mechanism 152 is angled at a lower slot 203 thereof such that, when the hook bolt 120 is in the extended position (as shown in FIG. 8A), the hook bolt 120 is prevented from moving relative to the chassis 102 as the deadbolt arm 156 is aligned with the deadbolt 150 and a retracting force on the deadbolt will simply cause the lower slot 203 of the slot 201 to bear against the protrusion of the deadbolt arm 156 without rotating the deadbolt arm.

According to the present embodiment, the deadbolt 150 partially contains a lowermost hook 300*a* and an uppermost hook 300*b* which move from a disengaged position to an engaged position as the deadbolt 150 is extended. In this embodiment, the hooks 300*a*, 300*b* are linked together, such that they move concurrently between the disengaged and engaged positions. Of course, any suitable arrangement of the hooks may be employed such that the hooks are automatically deployed as the hook bolt moves from a retract hook bolt position to an extended hook bolt position. In the depicted embodiment, the lowermost hook 300*a* includes a lower hook leg (see FIGS. 8B-8C) constructed and arrange to rotate the hooks 300*a*, 300*b* between the engaged and disengaged positions, as discussed above. In this embodiment, as the hook bolt is moved toward the extended position, the lower hook leg contacts front plate 104 which provides a reaction force that causes the hooks 300*a*, 300*b* to rotate and project out of the deadbolt. Similarly, as the hook bolt is moved toward the retracted position, the hooks 300*a*, 300*b* contact the front plate 104 which provides a reaction force that causes the hooks 300*a*, 300*b* to rotate toward the disengaged position, where the hooks are substantially contained by the deadbolt 150. In some other embodiments, as explained above, the depicted hook bolt 120 may include a hook actuator with a contact area arranged to contact a lower hook leg to move one or more hooks between the disengaged and engaged positions. As shown in the figure, the hooks 300*a*, 300*b* project substantially out of the deadbolt 150 when in the engaged position, and are positioned substantially inside of the deadbolt 150 when the hooks are in the disengaged position.

Lower deadbolt leg 154 may include one or more catches 160 (e.g. serrations, ratchets, teeth, cutouts) formed on a lower edge thereof. In some embodiments, the one or more catches 160 may be arranged to engage a portion of a sear or other suitable projection on an engagement side of the catch, thereby preventing the deadbolt 150 from extending. In some embodiments, the sear may be constructed and arranged to flex out of the way of the lower deadbolt leg 154 when the hook bolt 120 moves toward the retracted hook bolt position. In other embodiments, the sear is constructed rigidly so that the sear remains stationary relative to the guard lever as the hook bolt 120 moves toward the retracted hook bolt position, as the present disclosure is not so limited. The one or more catches 160 may be arranged to allow the sear or other suitable projection to slide past when the deadbolt 150 is retracted. In one such arrangement, the one or more catches 160 may be configured to allow the deadbolt 150 to retract unimpeded regardless of the position of the sear or other suitable projection, but may prevent the deadbolt 150 from extending without a corresponding action to move and release the sear.

Deadbolt arm 156 is coupled to a deadbolt backstop 157 by a peg 155 on deadbolt arm 156 which is inserted through an opening or hole in backstop 157. Backstop 157 is configured to pivot about the screw 116 in the upper, right-hand side of the chassis 102. A deadbolt biasing member 159 is coupled to deadbolt backstop 157 (e.g., by being connected to the peg 155). The deadbolt biasing member 159 is configured as an extension spring biased such that it tends to pull backstop 157, which results in arm 156 engaging the slide mechanism 152 and ultimately causes hook bolt 120 to move the deadbolt 150 relative to the chassis 102 between a retracted hook bolt position and an extended hook bolt position. While in the present embodiment an extension spring is depicted, any suitable biasing member may be employed, including but not limited to a compression spring or torsion spring. In the arrangement shown, the deadbolt biasing member 159 is prevented from causing the hook bolt toward an extended hook bolt position by a sear 181 engaged in a catch 160 on lower deadbolt leg 154, which prevents the deadbolt 150 from moving relative to the chassis between a retracted hook bolt position and an extended hook bolt position. This is described further below.

As shown in the present embodiment, the latch assembly 100 may further include a latch bolt 122 constructed and arranged to be operable by a door handle. In some embodiments, the hook bolt may be configured to be actuated by the door handle coupled to the latch bolt, such that the door can be operated traditionally by a single handle. According to this embodiment, the automatic hook bolt would increase door security while avoiding any additional steps for operation. Latch bolt 122 includes latch bolt head 162 and latch bolt cylinder 164. Latch bolt head 162 includes an inclined surface configured to impact a door jamb, thereby forcing the latch bolt to move toward a retracted latch bolt position. The latch bolt head also protrudes from chassis 102 and front plate 104 when latch bolt 122 is in an extended latch bolt position and is within or substantially within a profile of the chassis 102 when latch bolt 122 is in the retracted latch bolt position. A latch biasing member 166 is surrounds a rod extending from the cylinder 164 and urges the latch bolt 122 to remain in the extended latch position.

A guard lever 180 includes a guard lever lower leg 182 and a guard lever arm 184. In some embodiments, guard lever 180 is supported in chassis 102 by an end of lever arm 184 being attached to rear plate 106. Guard lever 180 pivots relative to chassis 102 about the end of the guard lever supported in the rear plate 106, between an upper or free position (see FIG. 10A) and a lower or secure position (see FIG. 10B). In some embodiments, the pivoting movement is controlled and limited by an extension of the guard lever near stopping end 186 extending laterally into a slot 188 formed in one or both of side plates 112. When guard lever 180 is in its secure position, stopping end 186 of guard lever arm 184 acts to prevent latch bolt 122 from moving to its retracted position by contacting the latch bolt cylinder 164 and thereby blocking further retraction of the latch bolt 122 (see FIG. 10B).

In some embodiments, the guard lever arm 184 may include a guard biasing member (not shown in the figure) that urges the guard lever arm 184 toward either the secure or the free position. In one such arrangement, the guard lever arm 184 may include a spring that biases the guard member toward the secure position. In this embodiment, the first tab may prevent the downward movement of the guard lever arm 184 (i.e., toward the secure position) by engaging the guard lever 180 and forcing the guard lever arm 184 up (i.e., toward the free position). Accordingly, when the auxiliary bolt 124 retracts and the first tab 176 disengages with the guard lever arm 180, the guard lever arm 184 may be urged by the guard biasing member to the secure position, thereby releasing the sear 181 and allowing hook bolt 120 to extend. In another embodiment, the guard lever arm 184 may be urged upwards by the guard biasing member toward the free position, and the auxiliary arm 172 may be constructed and arranged to engage the guard lever lower leg 182 and move the guard leg down (i.e., toward the secure position) when the auxiliary bolt is retracted. While some embodiments of the latch assembly 100 include a guard biasing member, it can be appreciated that any suitable arrangement whereby the guard lever may be moved between a free and a secure position may be employed.

As shown in FIG. 7, the sear 181 projects upwardly from the guard lever 180 and is configured to engage one of the catches 160 on lower deadbolt leg 154 when guard lever 180 is in its free position to prevent the deadbolt 150 from moving to the extended deadbolt position. Because of the angle of the catches 160, the sear 181 does not prevent the hook bolt 120 from moving from the extended hook bolt position to the retracted hook bolt position. As shown in FIG. 7, the sear may be flexible, such that it can flex over the catches to allow easier retraction of the deadbolt 150 while still preventing the extension of the deadbolt 150 when the guard lever is in the free position. In some other embodiments, the sear may be constructed and arranged as a rigid tab extending from the guard lever arm 184. When guard lever 180 moves to its secure position (see FIG. 10B), sear 181 becomes disengaged from the catch 160, which allows hook bolt 120 to move to its extended hook bolt position. That is, the disengagement of sear 181 from the catches 160 on lower deadbolt leg 154, allows deadbolt biasing member 159 to move deadbolt backstop 157 and deadbolt arm 156, causing the protrusion on deadbolt arm 156 engaged with the slide mechanism 152 to move deadbolt 150 to its extended position.

Figure 10A:
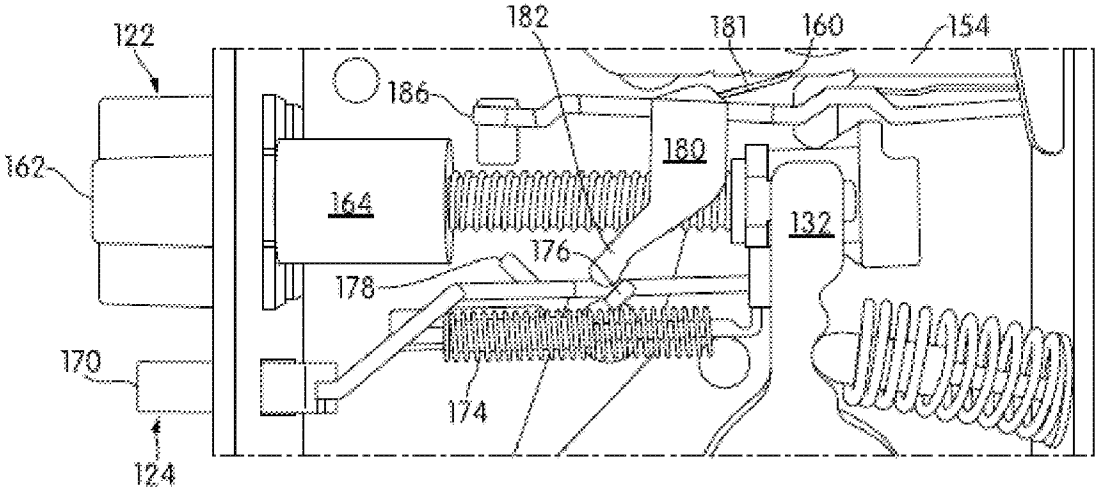
FIGS. 10A-10B illustrate detailed views of an auxiliary bolt within the latch assembly of FIG. 7.
Figure 10B:
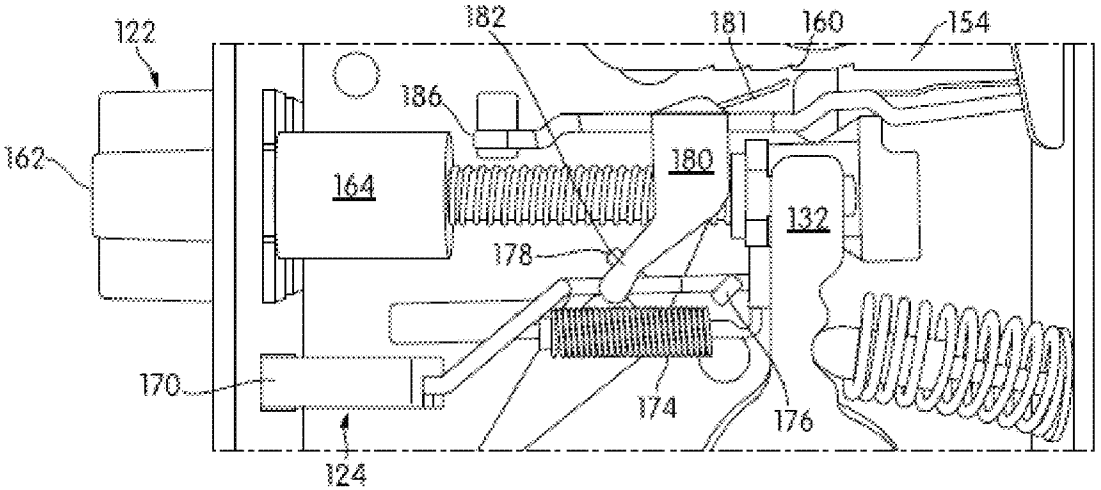

Auxiliary bolt 124 includes tongue 170 and auxiliary arm 172. Auxiliary bolt tongue 170 protrudes from chassis 102 and front plate 104 when auxiliary bolt 124 is in the extended auxiliary position and is within or substantially within a profile of the chassis 102 when auxiliary bolt 124 is in the retracted auxiliary position. Auxiliary bolt spring 174 is coupled with arm 172 and urges the auxiliary bolt 124 to remain in the extended auxiliary position. Auxiliary bolt arm 172 includes a first tab 176 and a second tab 178. As shown in FIGS. 7 and 10A, when auxiliary bolt 124 is in the extended position, the first tab 176 acts to prop up guard lever 180 by engaging its lower leg 182 to maintain guard lever 180 in its free position (allowing latch bolt 122 to move freely between its extended and retracted positions). As shown in FIG. 10B, when auxiliary bolt 124 is retracted, the first tab 176 is disengaged from lower leg 182 and the auxiliary arm 172 and/or second tab 178 engage lower leg 182, thereby moving the guard lever 180 to its secure position blocking latch bolt 122 from moving to its retracted position. In some embodiments, when latch bolt 122 is moved to its retracted position, latch bolt cylinder 164 makes contact with the second tab 178 of auxiliary bolt arm 172, causing auxiliary bolt 124 to also move to its retracted position.

As shown in FIG. 7, the latch assembly 100 may include a lever hub 130 with two aligned latch arms 132 coupled to the latch bolt 122, a lever spring 134, and two aligned holes 194. For example, a square shaft of a door handle may be inserted into each of the holes 194, such as an inside door handle and an outside door handle in each respective hole 194. The latch arms 132 are configured to move independently as the lever hub 130 rotates about an axis defined by the center of holes 194 between an open and a closed position, with lever spring 134 biasing them to their closed position as shown in FIG. 7. When the door handle inserted into the hold 194 rotates it will cause the corresponding latch arm 132 to move to its open position, engaging a contact at an end 196 of the rod extending from the latch bolt cylinder 164, thereby causing latch bolt 122 to move to its retracted position.

In some embodiments, the hook bolt 120 is coupled to the latch bolt 122 and the lever hub 130 so that if hook bolt 120 is in its extended hook bolt position, moving a latch arm 132 to its open position will additionally cause hook bolt 120 to move to its retracted position. In particular, a lower extending leg 153 of the deadbolt backstop 157 contacts the latch bolt end 196 located at the end of the rod extending from the latch bolt cylinder 164 when the hook bolt 120 is in the extended position (see FIG. 9A). When a latch arm 132 is rotated (e.g., via a door handle coupled to the opening 194), the contact 196 is moved, which contacts the lower leg 153 and pivots the deadbolt backstop 157, which rotates the deadbolt arm 156 so as to retract the deadbolt 150.

As shown in FIG. 7, the latch assembly 100 may include a lock switch mechanism 126 which further includes a switch (e.g., a rocker switch) 190 and a lock switch arm 192. Lock switch 126 has a locked switch position and an unlocked switch position. In some embodiments, lever hub 130 includes a notch 198 that is engaged by lock switch arm 192 when lock switch 126 is in its locked position, as shown in FIGS. 7 and 11B. In these embodiments, at least one of the one or more levers 132 will be prevented from moving. For example, none of the door handles attached to hole 194 will be able to open the door, or in some embodiments, only the exterior door handle will be prevented from opening the door while the interior door handle remains unaffected. According to these embodiments, when lock switch 126 moves to its unlocked switch position, lock switch arm 192 disengages from notch 198 (see FIGS. 9B-9D), thereby allowing the latch arms 132 to move. In some embodiments, the latch bolt mechanism 120 is coupled to the lock switch mechanism 126 so that when deadbolt 156 is moved to its extended position, lock switch 126 and lock switch rocker 190 are placed in their respective locked positions.

Figure 8B:
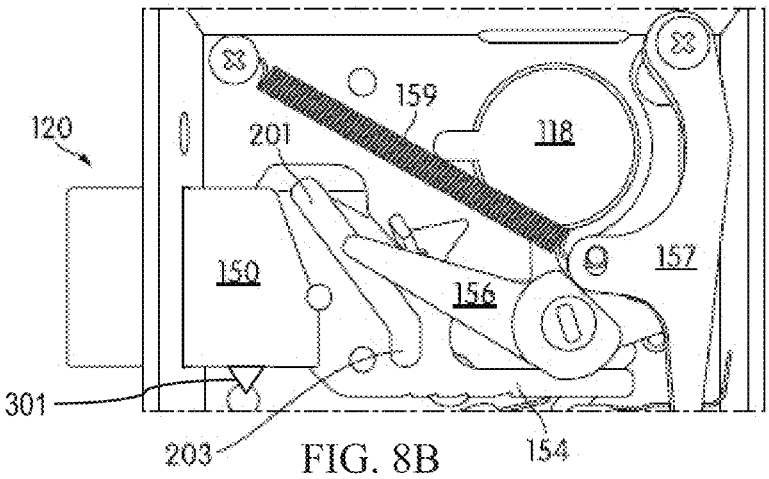
Figure 8C:
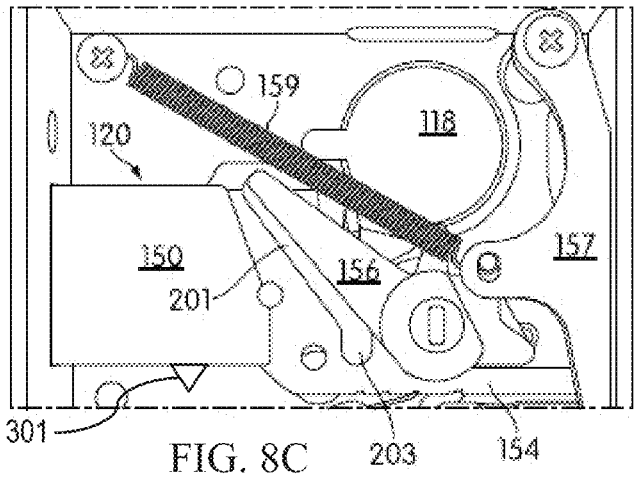
Figure 9B:
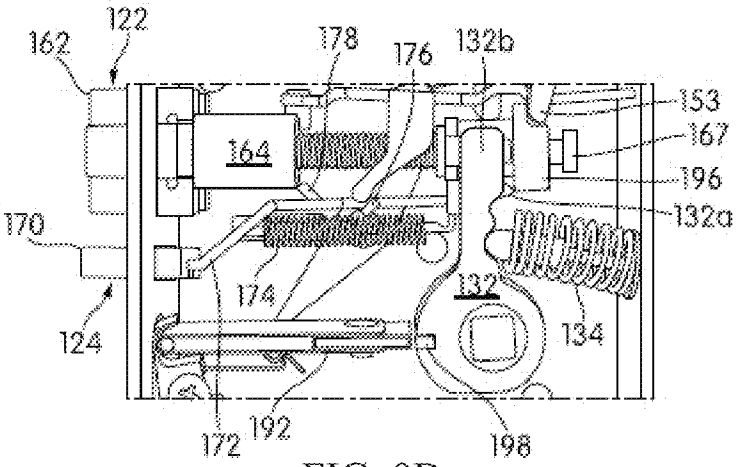
FIGS. 9A-9D illustrate detailed views of a latch bolt within the latch assembly of FIG. 7.
Figure 9D:
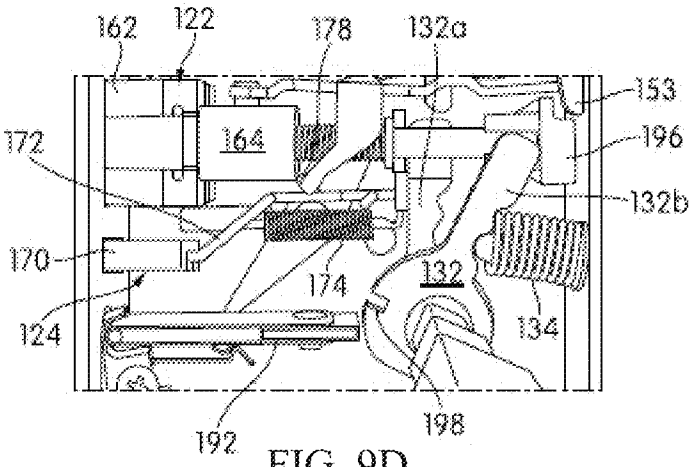
Figure 9A:
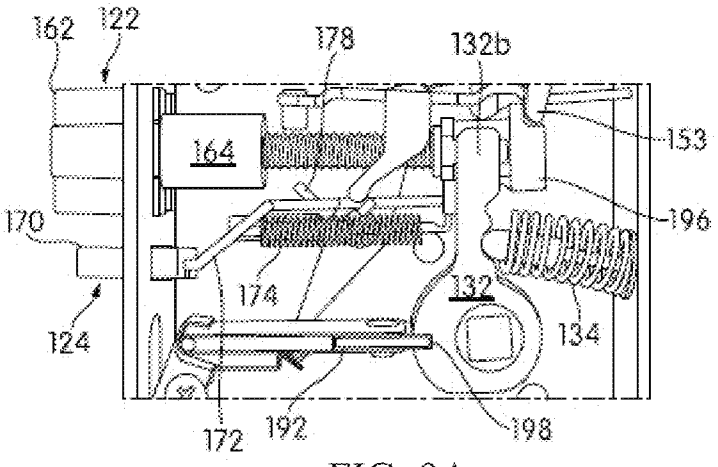
Figure 9C:
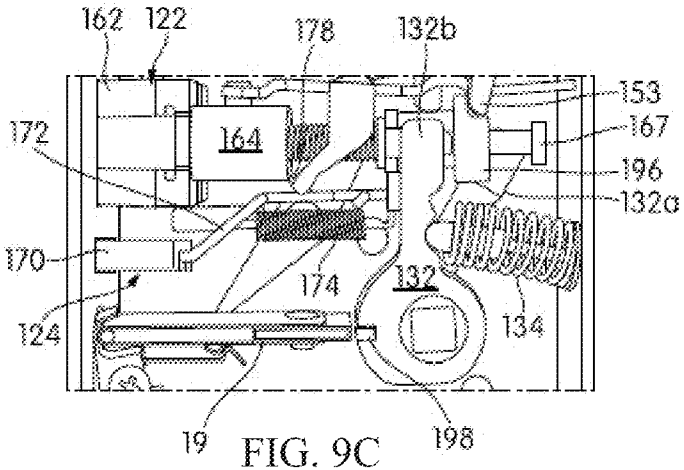

FIGS. 8A-8C further illustrate operation of the hook bolt 120 to move the deadbolt 150 relative to the chassis between an extended and a retracted deadbolt position and to move the hooks 300*a*, 300*b* between disengaged and engaged positions. In FIG. 8A, the deadbolt 150 is fully extended and deadbolt arm 156 is rotated to an aligned orientation with respect to the deadbolt 150 and engaged with the lower slot 203 of the sliding mechanism 152. As shown in the figure, the hooks 300*a*, 300*b* are in the engaged position, projecting laterally out of the deadbolt. In FIG. 8B, the deadbolt 150 is in a midway position between fully extended and fully retracted positions as the deadbolt arm is rotated to engage the obliquely-angled portion of the cam slot 201. In this position, the hooks have contacted front plate 104 and have rotated to the disengaged position, with lower hook leg 301 projecting out of deadbolt 150. In FIG. 8C, the deadbolt is fully retracted as the deadbolt arm has been fully rotated to engage the top end of the obliquely-angled portion of the cam slot 201. The interaction between the slide mechanism 152 and the deadbolt arm 156 is also shown. For example, as the deadbolt moves from a retracted to an extended position, the arm 156 moves along the angled portion of the cam slot 201 in the slide mechanism 152. As shown in FIG. 8A, when in the deadbolt 150 is in extended position, the protrusion of arm 156 is at a position in the lower slot 203 of the cam slot 201 such that an inward force applied to deadbolt 150 will not result in the protrusion of arm 156 moving along slot 201, thereby preventing such force from causing the deadbolt 150 to move to a retracted position FIGS. 9A-9D depict the various positions of lock switch 192 and lever hub 130 of the embodiment shown in FIG. 7. In FIG. 9A, latch bolt 122 is fully extended and latch arms 132 (including inside latch arm 132*a* and outside latch arm 132*b*) are each in their respective closed positions. In FIG. 9B, the latch bolt 122 is moved independently of the latch arms 132 against the bias of spring 166 (for example as the door is being closed and the latch bolt head 162 contacts the strike of the door frame) and is shown in a midway position between fully extended and fully retracted. Note that contact 196 and lower leg 153 remain stationary in contact with the latch arms 132, as a head 167 at the end of the rod extending from the latch bolt cylinder 164 extends through the contact 196 as the latch bolt 122 retracts. The latch bolt cylinder 164 has made initial contact with second tab 178 of the auxiliary bolt arm 172. In FIG. 9C, the latch bolt 122 is fully retracted as is the auxiliary bolt 124, again, independently of any movement of the latch arms 132. FIG. 9D shows the latch bolt 122 fully retracted, as actuated by the outside lever 132*b* which is rotated to its open position (while inside lever 132*a* remains in its closed position) and contacting the end 196 of the rod extending from the latch bolt cylinder 164, thereby causing latch bolt 122 to move to its retracted position.

FIGS. 10A-10B further illustrate movement of the auxiliary bolt 124 relative to the chassis between an extended and a retracted position. In FIG. 10A, the latch bolt 122 and the auxiliary bolt 124 are fully extended. Guard lever 180 is in its free position as first tab 176 contacts lower leg 182. With the guard lever 180 in its free (i.e., raised) position, sear 181 engages a catch 160 on lower deadbolt leg 154, thereby preventing extension of the deadbolt 150. In FIG. 10B, the auxiliary bolt 124 is fully retracted while the latch bolt 122 is still fully extended. This is the condition when the door is fully closed, the latch head 162 of the latch bolt 122 extends under the force of spring 166 into a latch pocket in the door frame but no pocket is provided in the door frame for the tongue 170 of the auxiliary bolt 124, and thus the auxiliary bolt 124 does not extend. With latch bolt 122 extended and the auxiliary bolt 124 not extended, the guard lever 180 is in its secure position, with sear 181 disengaged from catch 160 on lower deadbolt leg 154. With the sear 181 disengaged from the catch 160, the deadbolt 150 is able to automatically extend by action of the deadbolt spring 159 acting on the deadbolt backstop 157, which, in turn, due to the coupling of the deadbolt backstop 157 to the deadbolt arm 156 by the peg 155, causes the deadbolt arm 156 to rotate and thereby extend the deadbolt 150. Thus, when the door is closed, the deadbolt automatically extends into the locked position.

Figure 11A:
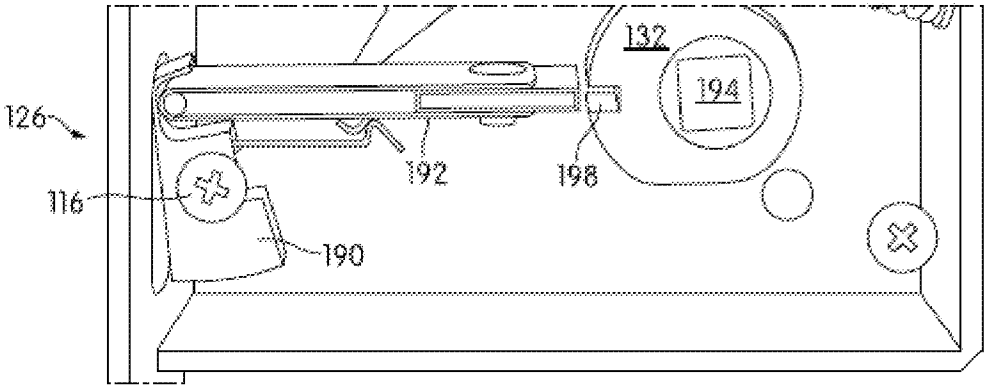
FIGS. 11A-11B illustrate detailed views of a lock switch within the latch assembly of FIG. 7.
Figure 11B:
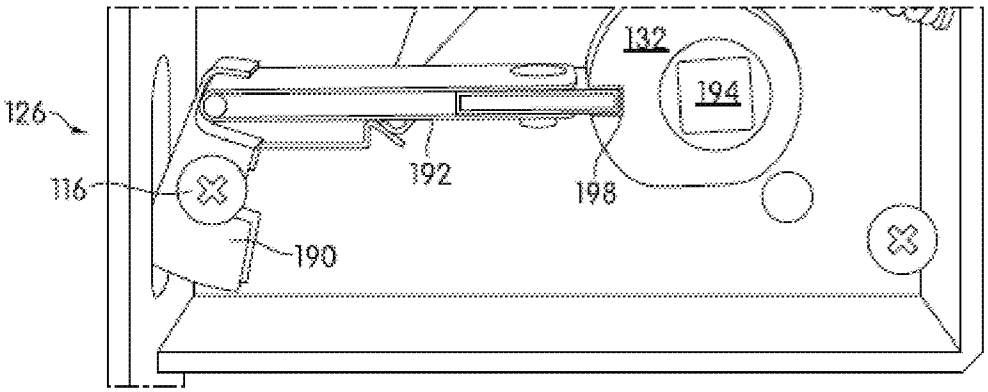

FIGS. 11A-11B further illustrate movement of the lock switch mechanism 126 between its locked switch position and its unlocked switch position. In FIG. 11A, the lock switch is in its open position, and lock switch arm 192 is disengaged from notch 198. In FIG. 11B, the lock switch is in its locked switch position, and lock switch arm 192 is engaged with notch 198. As noted previously, the lock switch mechanism 126 may be coupled to the hook bolt 120 so that the switch is moved to its locked position when the deadbolt is extended.

Figure 12:
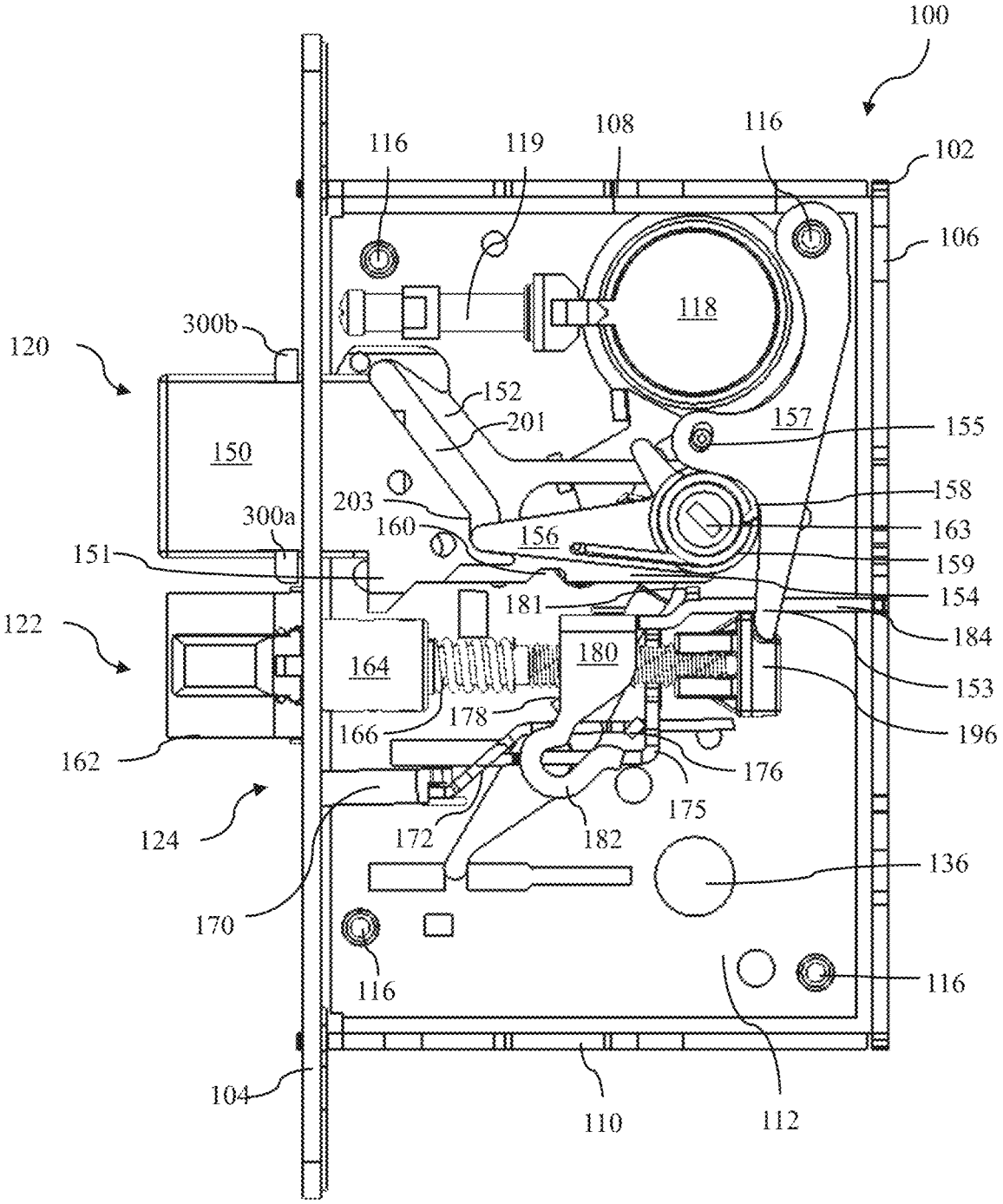
FIG. 12 illustrates a side view of a latch assembly according to yet another embodiment with a hook bolt in an extended position.

FIG. 12 illustrates another embodiment of a latch assembly 100. As shown in FIG. 12, the hook bolt 120 is in the extended position and the guard lever 180 is in the secure position. The relative positions of the hook bolt 120, latch bolt 122, and auxiliary bolt 124 as shown in FIG. 12 may occur when a door including the latch assembly is secure, for example, when the door is closed. In this arrangement, the hook bolt 120 is in the extended position, with hooks 300*a*, 300*b* in the engaged position projecting laterally outside of deadbolt 150. Additionally, deadbolt arm 156 fully rotated such that the apex of the arm is in the lower slot 203 of slide mechanism 152 to prevent movement of the deadbolt toward the retracted position. Guard lever 180 is in a secure position caused by auxiliary bolt 124 being in a retracted position and therefore causing auxiliary bolt arm 172 to contact lower guard lever leg 182 and force the guard lever 180 down (i.e., toward the secure position). In the secure position, sear 181 (constructed and configured here as a rigid sear on a guard lever arm 184) is in a position away from lower deadbolt leg 154, such that the sear 181 does not contact catch 160. Thus, the hook bolt 120 is free to move toward an extended hook bolt position, and is urged toward the extended position by the urging member 159 through the deadbolt arm 156 and slide mechanism 152. Latch bolt 122 is in the extended latch position, and urged toward the extended latch position by a latch biasing member 166.

In the present embodiment, the guard lever lower leg 182 is configured as a hook positioned around first tab 176. In this embodiment, the hook 182 acts to reliably move the guard lever arm 184 between the upper free position (see FIG. 15A) and the lower secure position (see FIG. 15B). As the auxiliary bolt 124 extends, the guard lever arm 184 is moved toward the free position by the hook 182 as it engages with first tab 176 of the auxiliary arm 172 to force the guard lever 180 up from the secure position to the free position. In the free position, the sear 181 engages the catch 160 to prevent the hook bolt 120 from extending. As the auxiliary bolt 124 retracts, the guard lever arm 184 is moved to the secure position by the hook 182 as it engages with first tab 176 and auxiliary arm 172 to force the guard lever 180 down from the free position to the secure position. In the secure position, the sear 181 is released from the catch 160, thereby allowing the hook bolt 120 to extend. According to the present arrangement, the hook 182 may allow the guard lever arm 184 to be moved between the secure and free positions more reliably and consistently than an arrangement with no hook. For example, the guard lever 180 may be moved by hook 182 contacting both the first tab 176, and auxiliary arm 172, thereby improving reliability of the movement between the free and secure positions. Similarly, the hook 182 may cause first tab 176 to move the guard lever 180 toward the secure position as the auxiliary bolt extends, thereby preventing contact between the sear 181 and deadbolt lower leg 154 as the deadbolt is retracted and reducing the chance of a jam. While in the present embodiment the guard lever 180 is constructed and configured as a hook, and suitable shape may be employed that allows the guard lever 180 to be reliably moved between the free and secure positions by the auxiliary arm 172 and/or one or more tabs.

As described previously and in the present embodiment, the lower slot 203 in combination with the deadbolt arm 156 prevents the deadbolt 150 from being moved toward the retracted position without actuation from a handle or locking device that would rotate the deadbolt arm 156 out of lower slot 203. In some embodiments, a handle may be installed in hole 136 that actuates latch bolt 122 and specifically latch bolt end 196. Latch bolt end 196 contacts deadbolt backstop 157 when the hook bolt 120 is in the extended position. When the handle or locking device is actuated, the latch bolt end 196 may be moved to rotated deadbolt backstop 157 via lower leg 153, thereby rotating deadbolt arm 156 via pin 155 to retract hook bolt 120. According to this embodiment, the handle or locking device may retract the latch bolt 122 and hook bolt 120 simultaneously. Such an arrangement may be beneficial in order to simply operation of the latch assembly 100 from an interior side of a door, while still providing the enhanced security from the automatic deadbolt extension and deadlocking when the door is closed.

In the embodiment shown in FIG. 12, the hook bolt 120 includes a deadbolt biasing member 159 configured as a torsion spring located on a deadbolt arm 156. Such an arrangement may be beneficial to reduce the occupied space of a chassis 102 of the latch assembly 100, thereby freeing space for other possible components. According to the present embodiment, the latch assembly 100 includes a lock adjustment device 119. The lock cylinder adjustment device 119 is constructed and configured to secure a lock mechanism, such as a key-operated cylinder lock, an electromechanical lock, or other suitable locking device in space 118. In some embodiments, the lock adjustment device is accessible from front plate 104 of the chassis 102. In such an arrangement, the lock adjustment device cannot be manipulated when the door is closed.

In the embodiment depicted in FIG. 12, the latch assembly 100 includes an auxiliary bolt guide 175. Auxiliary bolt guide 175 transmits force from the auxiliary biasing member (not shown in the figure) to urge auxiliary bolt 124 toward the extended position. In some embodiments, auxiliary biasing member is configured as a compression spring located around the auxiliary guide 175. The auxiliary biasing member is constructed and arranged to contact the auxiliary bolt guide 175 and auxiliary bolt arm 172. Thus, a compressive force is created between the auxiliary bolt guide 175 and the auxiliary arm 172 which urges the auxiliary bolt 124 toward an extended auxiliary position. The auxiliary bolt guide 175 may also guide the auxiliary bolt between its extended and retracted positions by sufficiently contacting the auxiliary bolt arm 172 to prevent movement not toward its extended or retracted positions (e.g., lateral movement). According to the present embodiment, the auxiliary bolt guide 175 may be fixed to the chassis 102, such that the auxiliary biasing member can urge the auxiliary bolt toward the extended position by contacting the auxiliary bolt guide 175 and auxiliary bolt leg 172.

As depicted in FIG. 12, the deadbolt 150 may also include a deadlocking tab 151. The deadlocking tab 151 is configured to engage a latch bolt head 162 to prevent the deadbolt from extending when the latch bolt is in a retracted latch position. Similarly, the deadlocking tab 151 prevents the latch bolt from retracting when the deadbolt 150 is in an extended position. Accordingly, the deadbolt is first retracted by deadbolt arm 156 in order for the latch bolt head 162 to retract. Without wishing to be bound by theory, such an arrangement may increase security of an adjoined door by increasing the number of locking points along the door frame, thereby increasing locking strength of the latch assembly 100. In the present embodiment, the latch bolt head 162 is first extended in order for the hook bolt 120 to extend. Such an arrangement may prevent the deadbolt from extending prior to the complete closure of the door when the latch bolt head 162 is able to extend into a door frame pocket. By preventing the hook bolt 120 from extending prior to the latch bolt head 162 entering the door frame pocket, the deadbolt 150 may be sufficiently aligned with the door frame pocket such that the deadbolt avoids impacting the door frame which may cause a jam or other undesirable effects (e.g., damage to the door frame).

Figure 13:
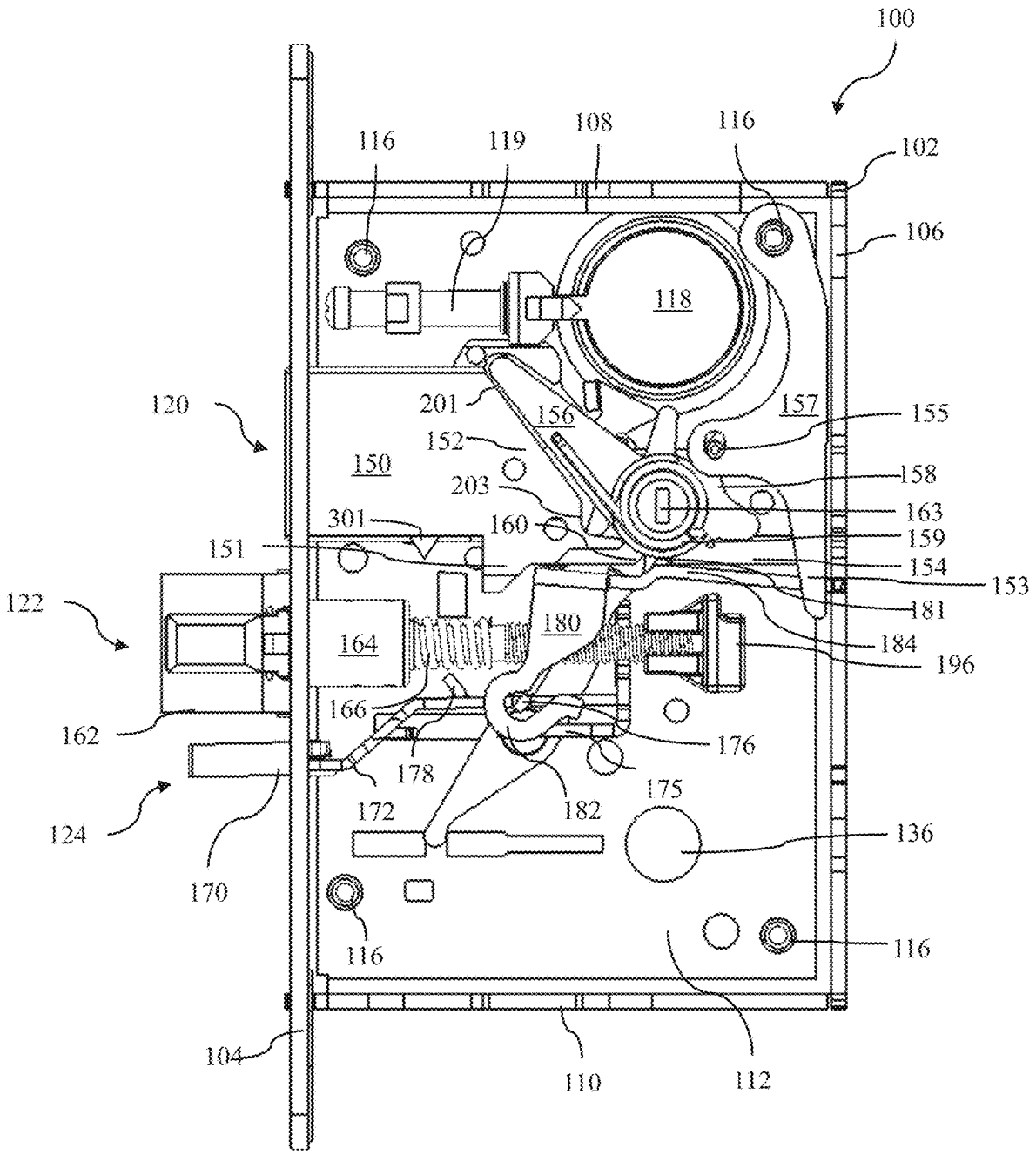
FIG. 13 illustrates a side view of the latch assembly of FIG. 12 with the hook bolt in a retracted position.

FIG. 13 illustrates the embodiment of the latch assembly 100 of FIG. 12 with the hook bolt 120 in the retracted position and the guard lever in the free position. The relative positions of the hook bolt 120, latch bolt 122, and auxiliary bolt 124 as shown in FIG. 13 may occur when an associated door is unsecure, for example, when the door is open. In this arrangement, the hook bolt 120 is in the retracted position, with the hooks accordingly in the disengaged position. In the disengaged position, the hooks are contained by the deadbolt 150 except for the lower hook leg 301 projecting out of the bottom of the deadbolt 150. Also in this position, deadbolt arm 156 is rotated into angled cam slot 201 of slide mechanism 152 and the deadbolt 150 sufficiently contained within the chassis 102. Guard lever 180 is in a free position caused by auxiliary bolt 124 being in an extended position and therefore causing first tab 176 to contact lower guard lever leg 182 and force the guard lever 180 up (i.e. toward the free position). In the free position, sear 181 on a guard lever arm 184 is close proximity with lower deadbolt leg 154, such that the sear 181 contacts catch 160. Thus, the hook bolt 120 is prevented from moving toward the extended position, and the sear 181 resists urging force from the deadbolt biasing member 159.

Figure 14A:
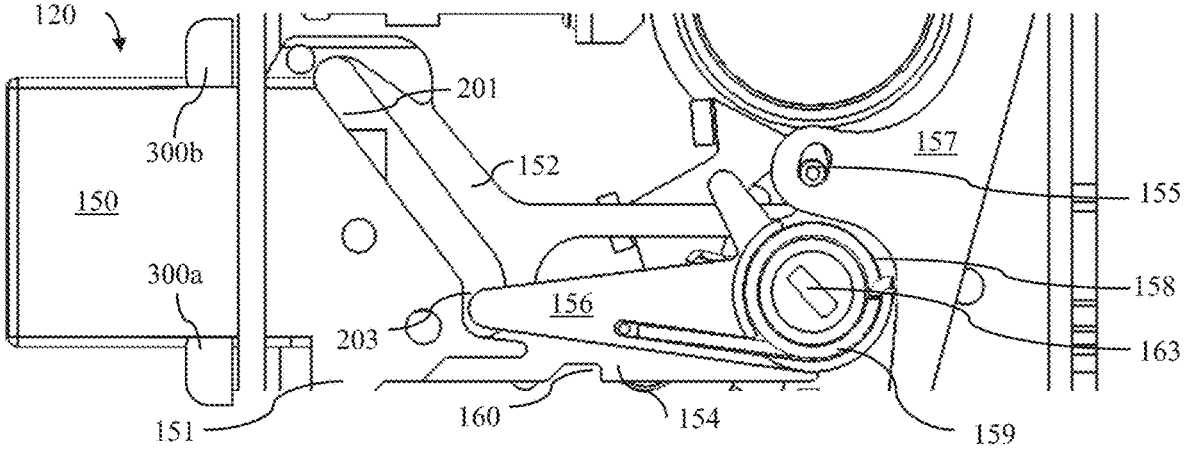
FIGS. 14A-14B illustrate detailed views of the hook bolt within the latch assembly of FIGS. 12-13.
Figure 14B:
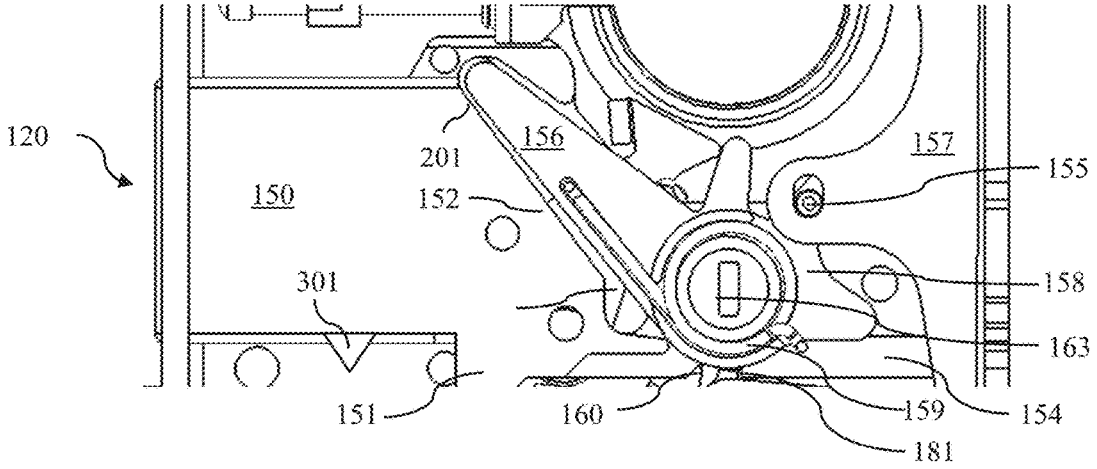

FIGS. 14A-14B further illustrate operation of the hook bolt 120 of FIGS. 12-13 to move the deadbolt 150 relative to the chassis between an extended hook bolt position and a retracted hook bolt position. In FIG. 14A, the deadbolt 150 is fully extended and deadbolt arm 156 is rotated to an aligned orientation with respect to the deadbolt 150 and engaged with the lower slot 203 of the slide mechanism 152. Accordingly, hooks 300*a*, 300*b* are in an engaged position, protruding laterally out of the deadbolt. In FIG. 14B, the deadbolt is fully retracted as the deadbolt arm has been fully rotated to engage cam slot 201 of an obliquely-angled portion of the slide mechanism 152. In this position, the hooks have been substantially rotated up into the deadbolt by contact with front plate 104, with lower hook leg 301 projecting from the bottom side of the deadbolt. The interaction between the slide mechanism 152 and the deadbolt arm 156 is also shown. For example, as the hook bolt moves from a retracted to an extended position, the arm 156 moves along the angled portion of the slide mechanism 152. As shown in FIG. 14A, when in the deadbolt 150 is in extended position, the protrusion of arm 156 is at a position in the lower slot 203 of the slide mechanism 152 such that an inward force applied to deadbolt 150 will not result in the protrusion of arm 156 moving along lower slot 203, thereby preventing such force from causing the hook bolt 120 to move to a retracted position.

Figure 15A:
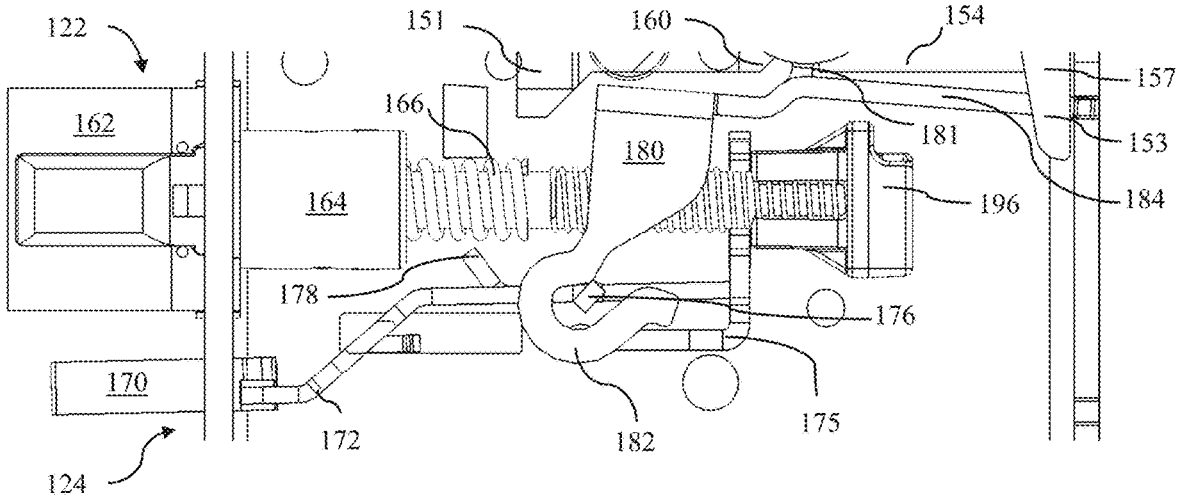
FIGS. 15A-15B illustrate detailed views of a latch bolt and an auxiliary bolt within the latch assembly of FIGS. 12-13.
Figure 15B:
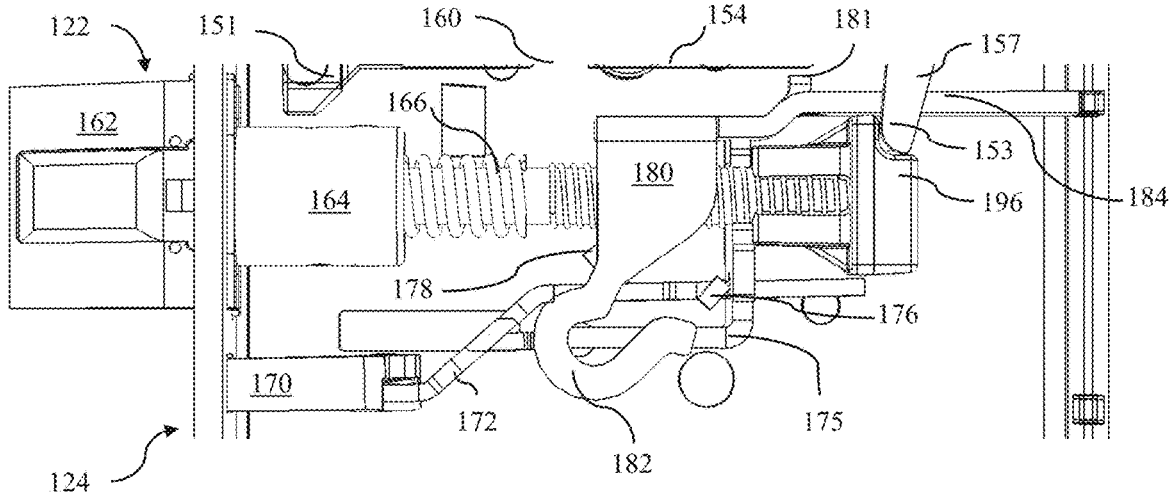

FIGS. 15A-15B further illustrate movement of the auxiliary bolt 124 of FIGS. 12-13 relative to the chassis between an extended and a retracted auxiliary position. In FIG. 15A, the latch bolt 122 and the auxiliary bolt 124 are fully extended. Guard lever 180 is in its free position as first tab 176 contacts and lifts lower leg 182 (i.e., moves lower leg 182 toward the free position). With the guard lever 180 in its free (i.e., upper) position, sear 181 engages a catch 160 on lower deadbolt leg 154, thereby preventing extension of the deadbolt 150. In FIG. 15B, the auxiliary bolt 124 is fully retracted while the latch bolt 122 is still fully extended. This is the condition when the door is closed, the latch head 162 of the latch bolt 122 extends under the force of latch biasing member 166 into a pocket in the door frame but no pocket is provided in the door frame for the tongue 170 of the auxiliary bolt 124, and thus the auxiliary bolt 124 does not extend. With latch bolt 122 extended and the auxiliary bolt 124 not extended, the guard lever 180 is in its secure position, with sear 181 disengaged from catch 160 on lower deadbolt leg 154. With the sear 181 disengaged from the catch 160, the deadbolt 150 is able to automatically extended by action of the deadbolt biasing member 159 acting on the deadbolt backstop 157, which, in turn, due to the coupling of the deadbolt backstop 157 to the deadbolt arm 156 by the peg 155, causes the deadbolt arm 156 to rotate and thereby extend the deadbolt 150. Thus, when the door is closed, the deadbolt automatically extends into the locked (i.e., extended) position.

Figure 16:
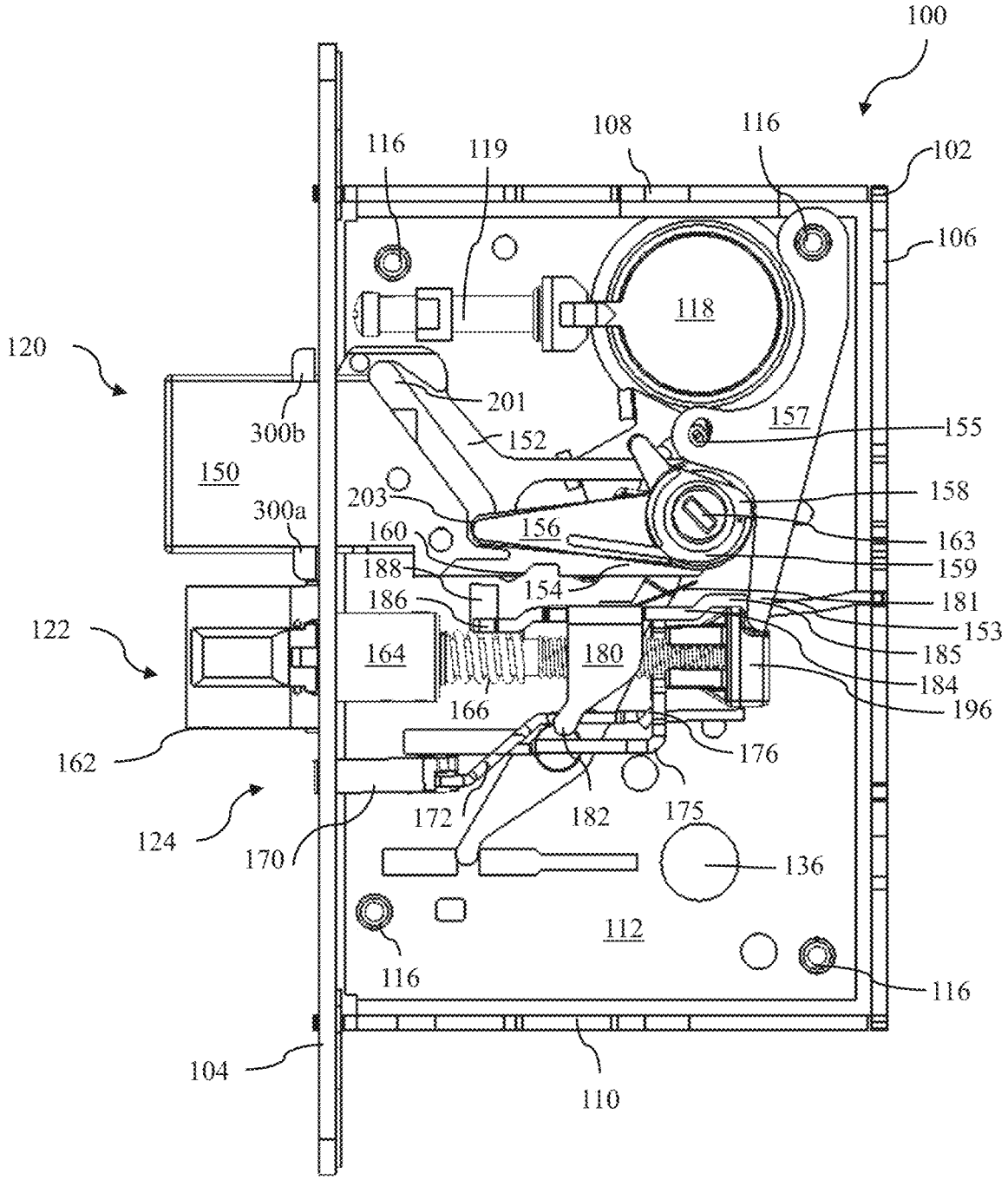
FIG. 16 illustrates a side view of a latch assembly according to yet another embodiment with a hook bolt in an extended position.

FIG. 16 illustrates yet another embodiment of a latch assembly 100 with the deadbolt 150 in the extended position and the guard lever 180 in the secure position. The relative positions of the hook bolt 120, latch bolt 122, and auxiliary bolt 124 as shown in FIG. 16 may occur when an associated door is secure, for example, when the door is closed. In this position, the hook bolt 120 is in the extended position, with hooks 300*a*, 300*b* in the engaged position projecting laterally outside of deadbolt 150. Additionally, deadbolt arm 156 is fully rotated into lower slot 203 of slide mechanism 152. In this embodiment, deadbolt arm 156 is urged into lower slot 203 by deadbolt biasing member 159 constructed and arranged as a torsion spring. Hook bolt 120 is able to extend as guard lever 180 is in the lower (i.e. secure) position. When the guard lever 180 is in the lower position, the sear 181 (constructed and arranged here as flexible projection attached to guard lever 180), is removed from contacting catch 160, which would prevent deadbolt 150 from moving toward the extended position. Guard lever 180 is moved to the secure position by auxiliary bolt 124 when the auxiliary bolt is in a retracted position. Auxiliary bolt 124 includes tongue 170, which is constructed and arranged with at least one inclined side to cause the auxiliary bolt to retract when tongue 170 strikes a door frame. The auxiliary bolt 124 also includes auxiliary bolt arm 172, which further includes first tab 176. As the auxiliary bolt is retracted by tongue 170, auxiliary bolt arm 172 contacts lower guard leg 182, thereby forcing the guard lever 180 down (i.e., toward the secure position). Auxiliary bolt 124 also includes auxiliary bolt guide 175 and auxiliary biasing member (not shown in the figure) located on the auxiliary bolt guide 175. Auxiliary bolt guide 175 is connected to the auxiliary biasing member in order to urge the auxiliary bolt toward the extended position. In the present embodiment, the auxiliary biasing member is located on the auxiliary bolt guide, and the auxiliary bolt guide is rigidly mounted in chassis 102, such that the urging member can urge auxiliary bolt 124 toward the extended position.

As shown in FIG. 16, guard lever arm 184 includes a stopping end 186 constructed and configured to prevent the retraction of latch bolt head 162 when the guard lever 180 is in the secure position. In certain embodiments, the pivoting movement of the guard lever arm 184 is controlled and limited by an extension of the guard lever near the stopping end extending laterally into a slot 188 formed in one or both of side plates 112. When the guard lever 180 is in its secure position, the stopping end 186 of the guard lever arm acts to prevent the latch bolt 122 from moving to its retracted position by contacting the latch bolt cylinder 164 and thereby blocking further retraction of the latch bolt 122. In some cases, it may be beneficial for the guard lever 180 to be moved to the free position when the handle is actuated, such that the stopping end 186 is moved away from the latch bolt cylinder 164 such that the latch bolt 122 can be retracted. Accordingly, the guard lever arm 184 includes a guard inclined section 185 constructed and arranged to abut the end 196 of the latch bolt 122. When the end 196 is moved by a door handle, it abuts the guard inclined section 185 and moves the guard lever 180 toward the free position. As the guard lever 180 is moved toward the free position the stopping end 186 is lifted (i.e. moved toward the free position), such that the latch bolt 122 can retract without contacting the stopping end 186. In such an arrangement, the guard lever 180 can be moved toward the free position and the latch bolt 122 can be retracted with a single actuation of the handle.

In some cases, it may be beneficial to prevent the hook bolt 120 from extended without using a deadlocking tab as described previously. Accordingly, the stopping end 186 may also prevent the hook bolt 120 from extending. In the case where guard lever 180 is in the free position, stopping end 186 is elevated above latch bolt cylinder 164 (see FIG. 17). If the latch bolt 122 is in the retracted position, latch bolt cylinder 164 is moved to a retracted position, below stopping end 186 near slot 188. In this position, the guard lever 180 is prevented from moving to the secure position as stopping end 186 contacts an upper portion of latch bolt cylinder 164. Thus, the guard lever 180 remains in the free position even if auxiliary bolt 124 is retracted. According to the present embodiment, auxiliary bolt arm 172 is sufficiently below guard lever 180, such that when the stopping end 186 abuts on the latch bolt cylinder 164 and prevents the guard lever 180 from moving to the secure position the auxiliary arm 172 is unable to contact and force guard lever 180 down (i.e. toward the secure position). Such an arrangement may prevent damage to latch assembly 100 in the case the latch bolt 122 is in the retracted position and force is applied to tongue 170 which may cause the auxiliary bolt 124 to retract.

In some embodiments, the latch assembly includes a hole 136 configured and arranged to attach a lever hub and/or a handle. The handle may be configured to actuate an end 196 of the latch bolt 122. End 196 may also contact deadbolt backstop 157 via lower leg 153. When the handle is actuated, the latch bolt 122 and latch bolt end 196 may move toward the retracted latch position. Accordingly, the deadbolt backstop 157 may be pivoted by the latch bolt end 196, which may cause deadbolt arm 156 to be rotated by pin 155 which links the deadbolt backstop 157 and deadbolt arm 157. As deadbolt arm 156 is rotated by deadbolt backstop 157, hook bolt 120 is moved toward the retracted position by sliding mechanism 152. Thus, when an attached handle is actuated, the latch bolt 122 and hook bolt 120 may be moved toward their respective retracted positions simultaneously.

Figure 17:
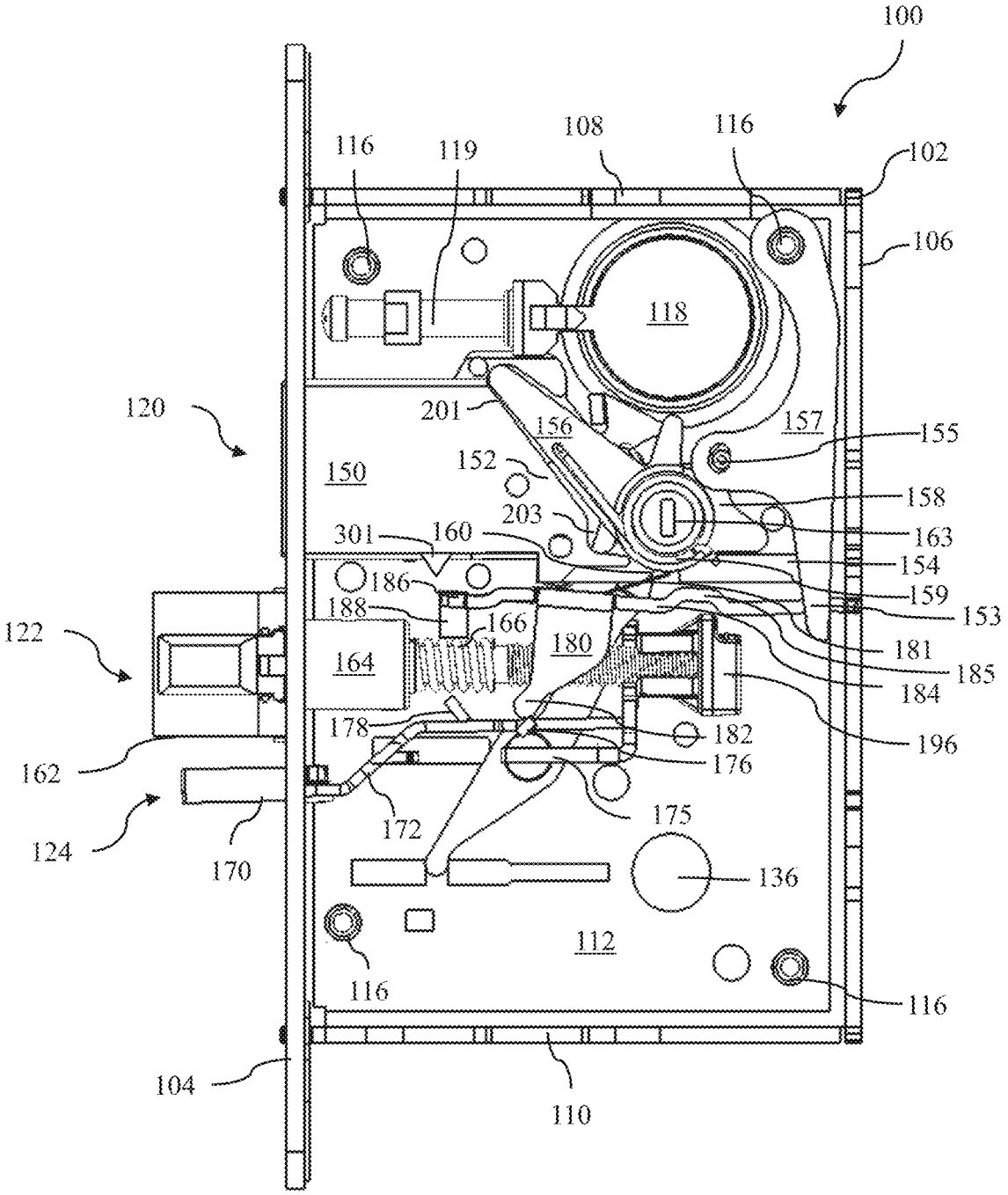
FIG. 17 illustrates a side view of the latch assembly of FIG. 16 with the hook bolt in a retracted position.

FIG. 17 illustrates the embodiment of the latch assembly 100 of FIG. 16 with the deadbolt 150 in the retracted position and the guard lever 180 in the free position. The relative positions of the hook bolt 120, latch bolt 122, and auxiliary bolt 124 as shown in FIG. 17 may occur when an associated door is unsecure, for example, when the door is open. In this arrangement, the hook bolt 120 is in the retracted position, with the hooks accordingly in the disengaged position. In the disengaged position, the hooks are contained by the deadbolt 150 except for the lower hook leg 301 projecting out of the bottom of the deadbolt 150. Also in this position, deadbolt arm 156 is rotated into an angled slot 201 of slide mechanism 152. Hook bolt 120 is unable to extend as guard lever 180 is in the upper (i.e. free) position. When the guard lever 180 is in the free position, the sear 181 (constructed and arranged here as a flexible projection attached to guard lever 180) contacts catch 160 which prevents deadbolt 150 from moving toward the extended position and resists urging force from the deadbolt biasing member 159. Guard lever 180 is moved to the free position by auxiliary bolt 124 when the auxiliary bolt is in an extended auxiliary position. Auxiliary bolt 124 also includes auxiliary bolt guide 175 and auxiliary biasing member (not shown in the figure). Auxiliary bolt guide 175 is connected to the auxiliary biasing member in order to urge the auxiliary bolt toward the extended position. In the present embodiment, the auxiliary biasing member is located on the auxiliary bolt guide 175, and the auxiliary bolt guide 175 is rigidly mounted in chassis 102, such that the urging member can urge auxiliary bolt 124 toward the extended position. The auxiliary bolt 124 also includes auxiliary bolt arm 172, which further includes first tab 176. As the auxiliary bolt is extended by auxiliary biasing member, first tab 176 contacts lower guard leg 182, thereby forcing the guard lever 180 up (i.e., toward the free position).

Figure 18C:
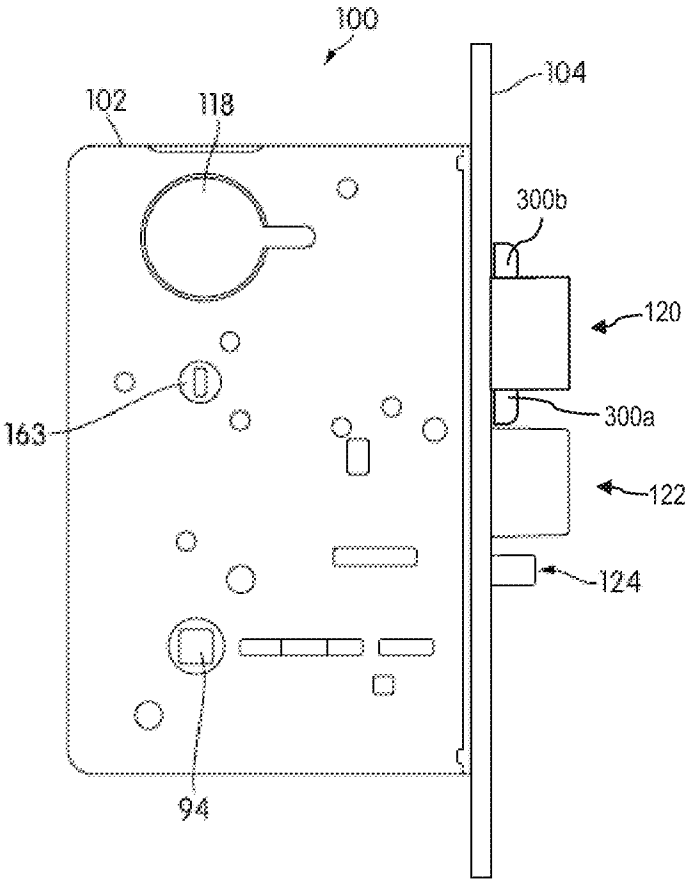
FIGS. 18A-18C illustrate views of embodiments of front, rear, and side plates respectively of a latch assembly.
Figure 18B:
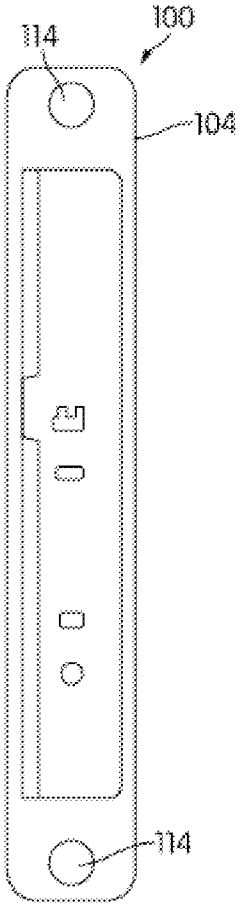
Figure 18A:
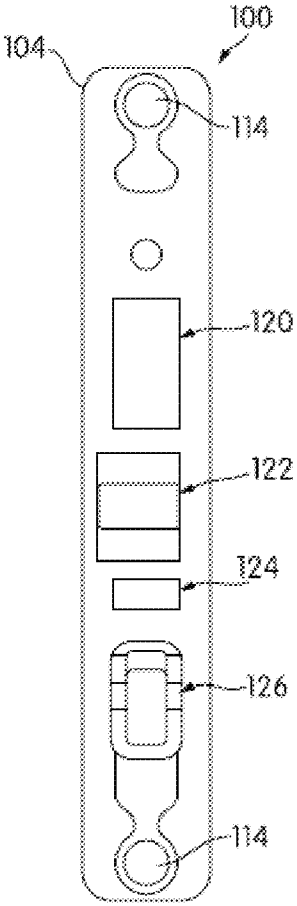

FIGS. 18A-18C further illustrate one embodiment of the chassis of the latch assembly 100. FIG. 18A shows a front view of front plate 104. Front plate 104 includes one or more screw holes 114 for mounting latch assembly 100 to a door. The front plate 104 further include cutouts to accommodate the hook bolt 120, latch bolt 122, auxiliary bolt 124 and allow their movement between extended and retracted positions. FIG. 18B shows a front view of rear plate 106. Rear plate 106 includes one or more screw holes 114 for mounting latch assembly 100 to a door. FIG. 18C shows a side view of the bottom one of the side plates 112 with latch bolt 122 and auxiliary bolt 124 in their respective extended positions. The side plates 112 include one or more cutouts for mounting the components in the previously described embodiments, in addition to traditional door hardware components like handles, locking devices, etc.

Figure 19B:
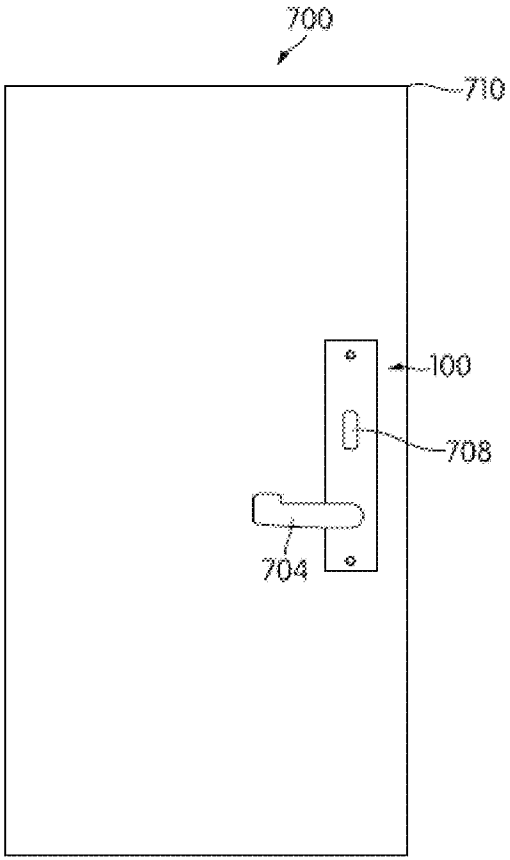
FIGS. 19A-19B illustrate views of a door including a latch assembly.
Figure 19A:
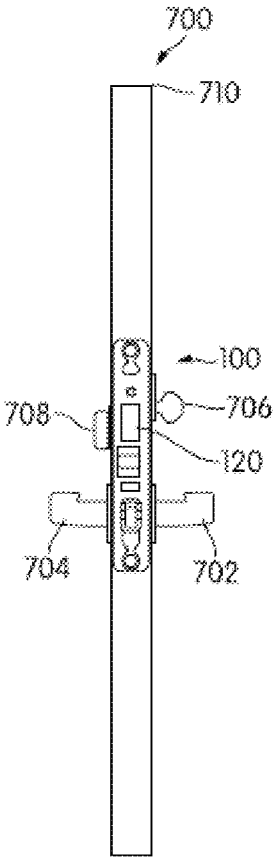

FIGS. 19A-19B illustrate one embodiment of a door system including a latch assembly 100. As shown, a door system 700 includes a door 710 having a latch assembly such as latch assembly 100 installed thereon. As fully installed, the door system may further include an outside door handle 702 and an inside door handle 704, each operable to open the door when unlocked. In some embodiments, inside door handle 704 may also be operable to open the door when it is locked. In some embodiments, a key 706 may be used to engage a key and core assembly which can lock or unlock the door system 700. Of course, any suitable credential may be employed, such that an authorized user can operate the door system. In some embodiments, latch assembly 100 may be installed on a door by an end user. A thumb knob 708 is configured to operate the hook bolt 120 to selectively extend or retract the deadbolt 150. In one embodiment, the knob 708 is coupled to slot of a thumb turn as shown previously. The latch assembly 100 is configured to automatically extend the hook bolt when the door 710 is closed as described above. In some embodiments, an associated door jamb strike plate for use with the door system may have an opening with an additional recess inside of the door jamb located in at least one direction perpendicular to the direction of movement of a hook bolt. Accordingly, the recess may be constructed and arranged to accommodate (i.e., receive) one or more hooks of the hook bolt that may deploy from a deadbolt that protrudes into the opening. Such an arrangement may prevent the one or more hooks from jamming in a door frame, or otherwise permit the hook bolt to reach the engaged position such that the door is secured.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

What is claimed is:

1. A hook bolt for a latch assembly, the hook bolt comprising:

a deadbolt constructed and arranged to move between a retracted deadbolt position and an extended deadbolt position;

a first hook and a second hook each located at least partially within the deadbolt, wherein the first hook and the second hook are rotatably and directly attached to the deadbolt, wherein the first hook and the second hook are constructed and arranged to move between a disengaged position and an engaged position, wherein the first hook and the second hook are further constructed and arranged to move from the disengaged position to the engaged position as the deadbolt moves from the retracted deadbolt position to the extended deadbolt position, and wherein the first hook and the second hook are further constructed and arranged to move from the engaged position to the disengaged position as the deadbolt moves from the extended deadbolt position to the retracted deadbolt position; and a hook actuator constructed and arranged to move the first hook between the disengaged position and the engaged position, the hook actuator comprising:

a fixed hook actuator block including a recess, wherein the recess is constructed and arranged to contact the first hook when the deadbolt moves between the retracted deadbolt position to the extended deadbolt position and the hook actuator block remains stationary relative to a chassis of the latch assembly, wherein the recess is further constructed and arranged to provide a first reaction force on the first hook to move the first hook toward the engaged position, wherein the recess is further constructed and arranged to provide a second reaction force on the first hook to move the first hook toward the disengaged position, wherein the first hook and the second hook are linked such that the first hook and the second hook move concurrently toward the engaged position solely in response to the first reaction force provided on the first hook and the first and second hook move concurrently toward the disengaged position solely in response to the second reaction force provided on the first hook.

2. The hook bolt of claim 1, wherein the first hook and the second hook include at least one pivot disposed in the deadbolt, and wherein the first and the second hook are constructed and arranged to rotate about the at least one pivot to move between the disengaged position and the engaged position.

3. The hook bolt of claim 1, wherein the first hook projects out of a first side of the deadbolt in the engaged position and the second hook projects out of a second side of the deadbolt in the engaged position, and wherein the second side is opposite the first side.

4. The hook bolt of claim 3, wherein the first hook is constructed and arranged to project out of a top side of the deadbolt in the engaged position, and the second hook is constructed and arranged to project out of a bottom side of the deadbolt in the engaged position.

5. The hook bolt of claim 1, wherein the first hook and the second hook each include a gear.

6. The hook bolt of claim 5, wherein the gear causes the first hook and the second hook to move between the disengaged position and the engaged position concurrently.

7. The hook bolt of claim 1, further comprising a linkage, wherein the at least one hook comprise a first hook and a second hook, wherein the linkage is attached to the first hook and the second hook, and wherein the linkage causes the first hook and the second hook to move between the disengaged position and the engaged position concurrently.

8. The hook bolt of claim 1, wherein the first hook includes a lower leg, and wherein the recess is constructed and arranged to receive the lower leg.

9. The hook bolt of claim 1, wherein the first hook and the second hook are unbiased while moving between the engaged position and the disengaged position.

10. A latch assembly for a door, the latch assembly comprising:

a chassis;

a deadbolt supported by the chassis to automatically move relative to the chassis between a retracted deadbolt position and an extended deadbolt position, the deadbolt being held in the retracted deadbolt position;

a hook actuator fixed to the chassis and configured to remain stationary relative to the chassis;

a first hook and a second hook each having a hook shank and a hook bend, each of the hook shank and the hook bend located within the deadbolt when the deadbolt is in the retracted deadbolt position, wherein the first hook and the second hook are rotatably and directly attached to the deadbolt, and wherein the first hook and the second hook are constructed and arranged to automatically move between a disengaged position and an engaged position when the first hook contacts the hook actuator as the deadbolt moves between the retracted deadbolt position and the extended deadbolt position; and a trigger cooperating with the deadbolt, the trigger constructed and arranged to permit the deadbolt to move to the extended deadbolt position, with the first hook and the second hook being automatically moved from the disengaged position to the engaged position when the deadbolt is automatically moved from the retracted deadbolt position to the extended deadbolt position, wherein the hook actuator comprises a hook actuator block including a recess, wherein the recess is constructed and arranged to contact the first hook when the deadbolt moves between the retracted deadbolt position to the extended deadbolt position, wherein the recess is further constructed and arranged to provide a first reaction force on the first hook to move the first hook toward the engaged position, wherein the recess is further constructed and arranged to provide a second reaction force on the first hook to move the first hook toward the disengaged position, wherein the first hook and the second hook are linked such that the first hook and the second hook move concurrently toward the engaged position solely in response to the first reaction force provided on the first hook and the first and second hook move concurrently toward the disengaged position solely in response to the second reaction force provided on the first hook.

11. The latch assembly of claim 10, further comprising a deadbolt biasing member constructed and arranged to urge the deadbolt toward the extended deadbolt position.

12. The latch assembly of claim 11, wherein the deadbolt biasing member is constructed and arranged as a torsion spring.

13. The latch assembly of claim 10, wherein the first hook and the second hook include at least one pivot disposed in the deadbolt, and wherein the first hook and the second hook are constructed and arranged to rotate about the at least one pivot to move between the disengaged position and the engaged position.

14. The latch assembly of claim 10, wherein the first hook projects out of a first side of the deadbolt in the engaged position and the second hook projects out of a second side of the deadbolt in the engaged position, and wherein the second side is opposite the first side.

15. The latch assembly of claim 14, wherein the first hook is constructed and arranged to project out of a top side of the deadbolt in the engaged position, and the second hook is constructed and arranged to project out of a bottom side of the deadbolt in the engaged position.

16. The latch assembly of claim 10, wherein the first hook and the second hook each include a gear.

17. The latch assembly of claim 16, wherein the gear causes the first hook and the second hook to move between the disengaged position and the engaged position concurrently.

18. The latch assembly of claim 10, further comprising a linkage, wherein the at least one hook comprise a first hook and a second hook, wherein the linkage is attached to the first hook and the second hook, and wherein the linkage causes the first hook and the second hook to move between the disengaged position and the engaged position concurrently.

19. The latch assembly of claim 10, wherein the first hook includes a lower leg, and wherein the recess is constructed and arranged to receive the lower leg.

20. The latch assembly of claim 10, wherein the first hook and the second hook are unbiased while moving between the engaged position and the disengaged position.

21. A door system in combination with the latch assembly of claim 10, the combination comprising:

a door, said latch assembly coupled to said door; and a first handle coupled to said latch assembly and operable to open said door.

* * * * *